US005587774A

United States Patent [19]

Nagahara et al.

[11] Patent Number: 5,587,774

[45] Date of Patent: Dec. 24, 1996

[54] CLEANERLESS ELECTROGRAPHIC IMAGING DEVICE

[75] Inventors: Akira Nagahara; Sachio Sasaki; Mitsuhito Furukawa; Tsuneo Watanuki; Norio Sawatari, all of Kawasaki; Mikio Amaya, Atsugi; Toshiaki Narusawa, Kawasaki, all of Japan

[73] Assignee: Fujitsu Limited, Kawasaki, Japan

[21] Appl. No.: 434,991

[22] Filed: May 4, 1995

[30] Foreign Application Priority Data

Aug. 11, 1994 [JP] Japan ..... 6-189680

[51] Int. Cl.[6] ..... G03G 15/02; G03G 15/08

[52] U.S. Cl. ..... 355/219; 355/269

[58] Field of Search ..... 355/219, 271, 355/273, 274, 269

[56] References Cited

U.S. PATENT DOCUMENTS

| | | | |
|---|---|---|---|
| 4,309,803 | 1/1982 | Blaszak | 355/219 |
| 4,977,430 | 12/1990 | Florack et al. | 355/274 |
| 5,321,471 | 6/1994 | Ito et al. | 355/219 |

FOREIGN PATENT DOCUMENTS

| | | | |
|---|---|---|---|
| 0459607 | 12/1991 | European Pat. Off. | 355/269 |
| 2-259784 | 10/1990 | Japan | 355/269 |
| 4-267282 | 9/1992 | Japan | 355/269 |

*Primary Examiner*—Joan H. Pendegrass

*Attorney, Agent, or Firm*—Armstrong, Westerman, Hattori, McLeland & Naughton

[57] ABSTRACT

An imaging device for use in an electrographic imaging process, without a cleaning unit for residual toners, which comprises an image-carrying element, an image exposure means, a developing means, an image transfer means, and a distribution roller means of an elastic and electrically conductive material for uniformly distributing the residual toners over a surface of the image-carrying element and at the same time deelectrifying and recharging the same surface of said element. The imaging device has a simplified and compact structure and does not cause an environmental pollution problem due to the generation of ozone in the device.

64 Claims, 13 Drawing Sheets

CLEANERLESS ELECTROGRAPHIC IMAGING DEVICE

BACKGROUND OF THE INVENTION

1. Field of the Invention

The present invention relates to an imaging device for use in an electrography or electrographic imaging process. The imaging device does not use a conventional discrete charging device and cleaning unit, and accordingly has a simplified and compact structure and does not cause an environmental pollution problem. The imaging device can be advantageously used as, or in, a copier or copying machine, printer, facsimile device and other image-providing devices. The term "electrography" used herein means that it includes any image formation processes wherein a latent image is first produced on an image-carrying element and then it is developed with a developer to form the corresponding visible image, for example, electrophotography, xerography and the like.

2. Description of the Related Art

The conventional electrographic imaging device uses the series of process steps shown in FIG. 1. Namely, the process steps include:

(a) image exposure;

(b) development;

(c) image transfer;

(d) cleaning of the residual toners; and (e) pre-charging;

and these steps are repeated. In the image exposure step, an image-carrying element such as a photosensitive drum is exposed to image-forming light, i.e., light image, in an optical unit such as a LED array, to form a charged latent image after it has been sensitized by electrical charging in a preceding pre-charging step. The latent image is formed as a function of a photoconductive discharge of the electrically charged surface of the photosensitive drum. The formed latent image is physically developed using a toner or toning agent as a developer in a developing device. A visible image of the toner is formed on the drum surface as a result of an electrical attraction of fine particles of the toner thereon. The developed image of the toner is then transferred to an image-receiving element such as paper, and the transferred toner image is fixed thereon by fusing. In this image transfer step, some small amount of the toner remains on the surface of the photosensitive drum without being transferred to the paper, and it can adversely affect on the results of the subsequent imaging process if it is not removed from the drum. It is therefore essential in the conventional imaging process to remove the residual toner from the drum in a cleaning step, prior to reusing the drum for the next imaging process. After cleaning thereof, the drum is again sensitized, by electrical charging, in a pre-charging step.

FIG. 2 illustrates a typical example of the electrographic imaging device suitable for carrying out the above-described imaging process. A photosensitive drum 102 which is rotatable in the direction shown by an arrow is electrostatically charged by a pre-charging device 101 such as a scorotron charger. The drum 102 is then exposed to a light image from a LED array 103 which can emit light depending upon a predetermined imaging signal, thereby forming a charged latent image on the drum surface. The latent image is developed with fine particles of a developer or toner 105 in a developing device 104. A visible image of the toner is thus formed on the drum surface. The developed image is then guided to an image transfer station provided with an image transfer device 107, and is transferred to a paper 106 supplied from a paper cassette (not shown). The transferred image is fused and fixed to the paper 106 by means of a pair of fixing rollers 39. Since the drum 102 has a residual toner on a surface thereof, it is then cleaned in a cleaner 108. After removal of the residual toner from a surface thereof, the drum 102 is again charged by the pre-charging device 101 for reuse in the next imaging process.

The above-described imaging process and device, however, suffer from several drawbacks. The use of the cleaner is a bar to providing a compact and low price device, since it becomes necessary to use additional devices such as a device for disposing of the toner recovered in the cleaner and a device for storage the disposed toner. Alternatively, if the disposed toner is intended to be reused in the developing device, it becomes necessary to add an additional and expensive device for conveying the toner from the toner disposal device to the developing device. Further, disposal of the residual toner causes an environmental problem and increases the operation cost.

It has been found that the problems due to use of the cleaner can be solved if the imaging device uses the cleanerless imaging process, a flowchart of which is shown in FIG. 3, disclosed in U.S. patent application Ser. No. 220,208, filed on Mar. 31, 1994, which has been assigned to the applicant.

The cleanerless imaging process, as shown in FIG. 3, includes the following process steps:

(a) image exposure;

(b) development of a latent image and recovery of the residual toners;

(c) image transfer;

(d) distribution of the residual toners; and (e) pre-charging.

Comparing the process of FIG. 3 with that of FIG. 1, it will be appreciated that the cleanerless imaging process is distinguished from the conventional imaging process, because the residual toner is recovered in the development step and accordingly a cleaning step is omitted from the imaging process. Further, in order to assist in recovering the residual toner in the development step, the process includes a distribution step for the residual toner prior to pre-charging of the photosensitive drum. In this distribution step, the residual toner remaining on the surface of the drum after the image transfer step is uniformly distributed over the surface of the drum.

FIG. 4 illustrates a typical example of the imaging device for carrying out the above-described cleanerless imaging process. Note that, in order to simplify a comparison of the device of FIG. 4 with that of FIG. 2, the same reference numerals are assigned to the same devices, means or elements.

In the imaging device of FIG. 4, as described in detail in the above-cited U.S. Ser. No. 208, a developing device 104 can act as a recovery means for recovering the residual toner from the surface of the photosensitive drum 102, and as a developing means for the charged latent image formed as a function of image exposure in a LED array 103.

Positioned between an image transfer device 107 wherein the developed toner image is transferred from the drum 102 to a paper 106, and a pre-charging device 101 wherein the drum 102 is sensitized with electrical charging, is a distribution means 110 in the form of a rotatable roller. The distribution means 110 is preferably a conductive roller made of a foamed plastic material such as polyurethane, and is rotated in contact with the photosensitive drum 102 bearing the residual or not-transferred toner on a surface thereof. During the rotation thereof, the distribution means 110 can uniformly redistribute the patternwise distributed residual toner over the surface of the drum to thereby reduce the amount of the residual toner per the area of the drum surface. Such a uniform distribution of the residual toner can be further assisted by vibration of the distribution means 110 caused by an application of an AC voltage to said means 110 by means of an AC electric source 111. The application of the AC voltage is also effective to remove charge, i.e., deelectrify the charged surface of the drum 102, i.e., remove the remaining electric charge from the surface of the drum 102. The deelectrification of the drum surface will ensure a recovery of the residual toner in the developing device 104, because it can reduce the electrical attraction between the toner and the drum surface.

Although it has many important advantages, the prior art imaging device still suffers from some problems. First, since it is necessary to use the distribution means and the pre-charging device in combination, the imaging device cannot satisfy the requirements for a further reduction in size and for a further reduction in the production cost of the device. Second, a high voltage electric source must be used in combination with the pre-charging device. It is desired to avoid using such high voltage electric source, because it can generate ozone as an undesirable gas, in addition to increasing the size and cost of the device. Third, since small amounts of the paper dust can be conveyed into the developing device and shorten the life of the device, it is necessary to additionally locate a suitable dust removing means between the image transfer device and the developing device, however, such dust removing means also is a bar to providing a compact device.

SUMMARY OF THE INVENTION

It is therefore one object of the present invention to provide an improved imaging device for use in an electrographic imaging process, which has a simplified and compact structure and reduced size, and does not cause an environmental pollution problem due to the generation of ozone in the device.

Other objects of the present invention will be understand from the detailed description of the preferred embodiments of the present invention, described hereinafter.

According to the present invention, there is provided an imaging device, for use in an electrographic imaging process, which comprises:

an image-carrying element;

an image exposure means for forming a charged latent image on a surface of the image-carrying element;

a developing means for forming a visible image on the surface of the image-carrying element as a function of development of said latent image with a developer and, at substantially the same time, recovering a residual developer, not transferred to an image-receiving element in the preceding image transfer process, from the image-carrying element;

an image transfer means for transferring the visible developer image from the image-carrying element to an image-receiving element; and a distribution roller means of an elastic and electrically conductive material for uniformly redistributing the residual developer, not transferred to the image-receiving element in the above image transfer process, over the surface of the image-carrying element and, at substantially the same time, deelectrifying the charged surface of the image-carrying element with an AC electric field and, in combination with an application of a DC voltage, freshly charging the deelectrified surface of the image-carrying element;

with the proviso that a cleaning means for removing the residual developer, not transferred to the image-receiving element, from the image-carrying element is not located between said image transfer means and said image exposure means.

In one aspect of the present invention, the imaging device comprises a rotatable photosensitive drum as said image-carrying element, and said photosensitive drum has, on the peripheral surface thereof, in the recited order:

an optical image-providing system, selected from the group consisting of LED (light emitting diode), laser, liquid crystal shutter and EL (electroluminescence) optical systems, as said image exposure means;

a developing device including a development sleeve and a magnet roller as said developing means;

a transfer roller as said image transfer means; and an electrically conductive roller of an elastic material containing closed cells as said distribution roller means.

The photosentive drum of the imaging device may further comprise a dust removing brush between said transfer roller and said electrically conductive roller.

According to the present invention, since it does not use a conventional charging device such as a precharger, the imaging device effectively reduces the cost and hazard due to use of a high voltage electric source essential to such charging device, avoids an environmental pollution problem due to ozone generated from the charging device, and diminishes the size or required space of the imaging device because of the omission of the charging device. Further, according to the present invention, since a new space is produced as a result of omission of the charging device, a dust removing means may be added to said space to thereby extend a durability of the developing means and distribution roller means. Note that any dust from the image-receiving element such as paper dust can adversely affect the performances and properties of said means located after the image transfer means.

Using the described distribution roller means in the imaging device, it becomes possible to effectively and uniformly distribute the residual developer or toner, over the surface of the image-carrying element without causing uneven migration of the developer over the same surface. The prevention of such migration of the developer is particularly effective to extend the durability of the distribution roller means. The durability of the roller means can be further extended, if a surface coating is applied on the top surface of the roller means.

Because of these sand other advantages, the present invention provides an imaging device having a simplified and compact structure, and which causes no environmental problem and has a low production cost.

DETAILED DESCRIPTION 0F THE PREFERRED EMBODIMENTS

The present invention will be further described with reference to the preferred embodiments thereof.

Figure 1:
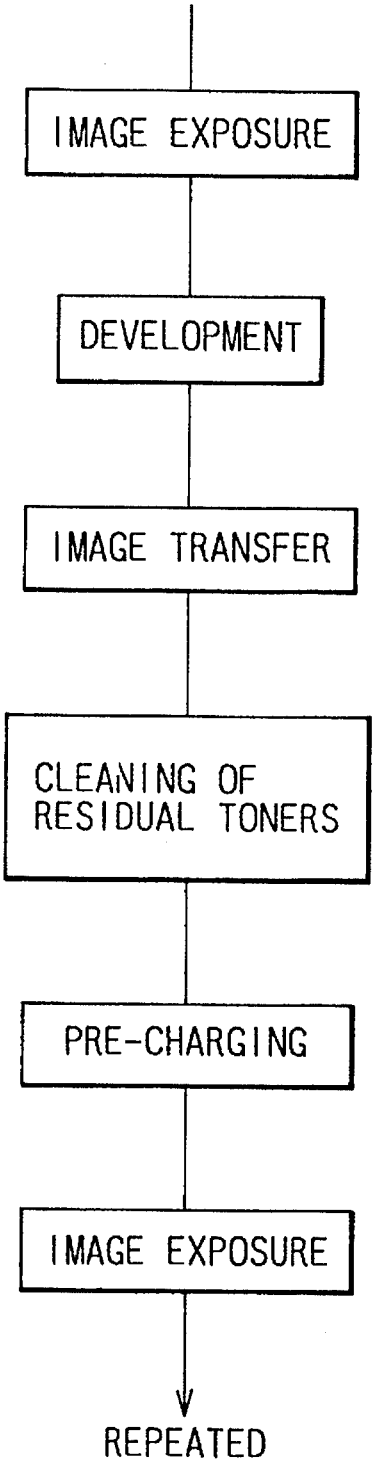
Fig.1 PRIOR ART
FIG. 1 is a diagramatic view showing the typical process steps of the prior art imaging device.
Figure 2:
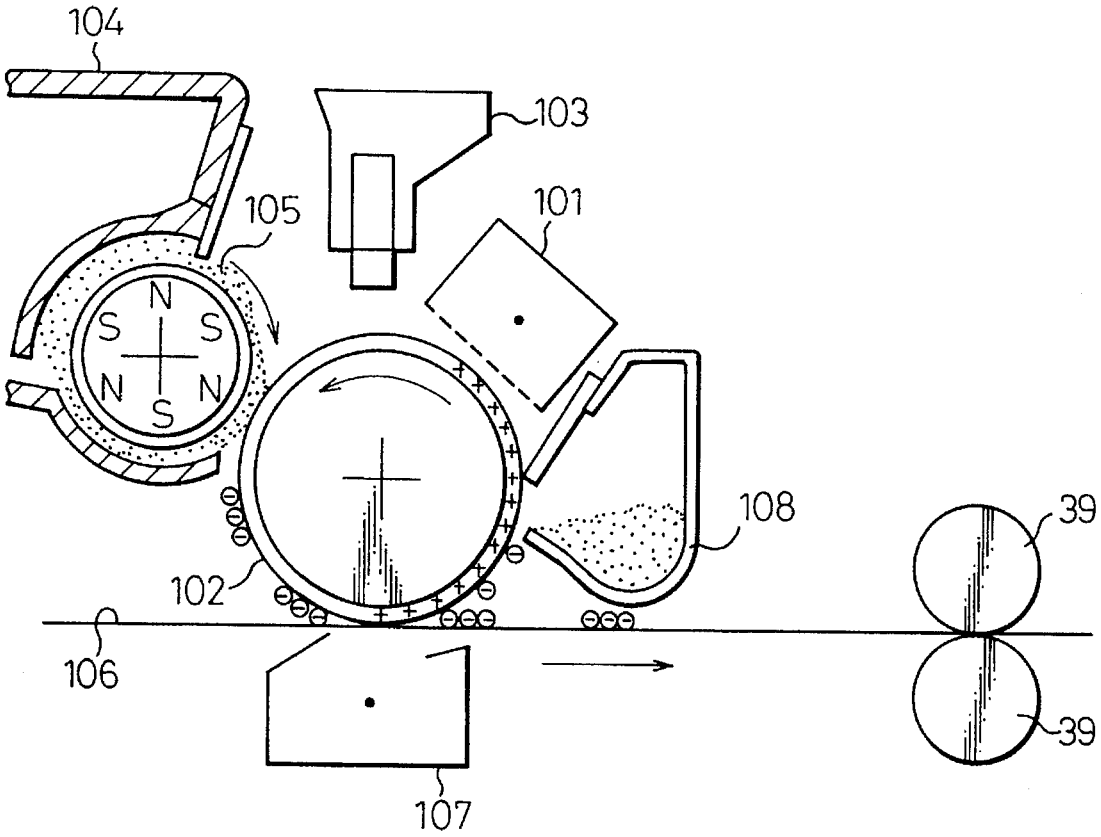
Fig.2 PRIOR ART
FIG. 2 is a cross-sectional view illustrating the prior art imaging device operable at the process steps shown in FIG. 1.
Figure 3:
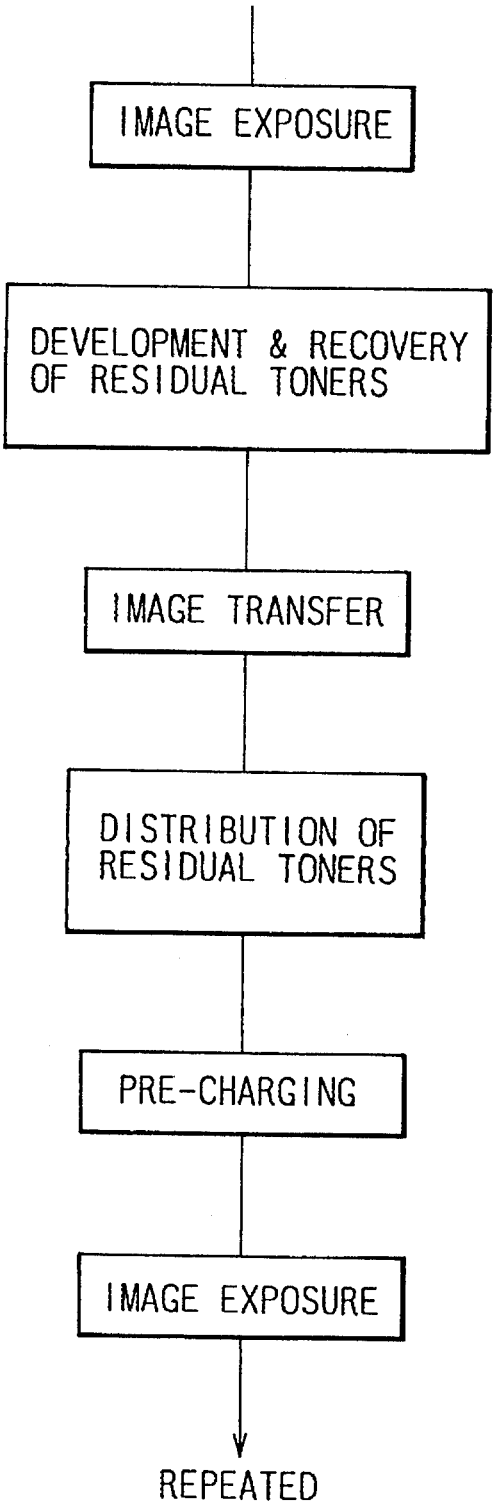
Fig.3 PRIOR ART
FIG. 3 is a diagramatic view showing the typical process step of the prior art cleanerless imaging device.
Figure 4:
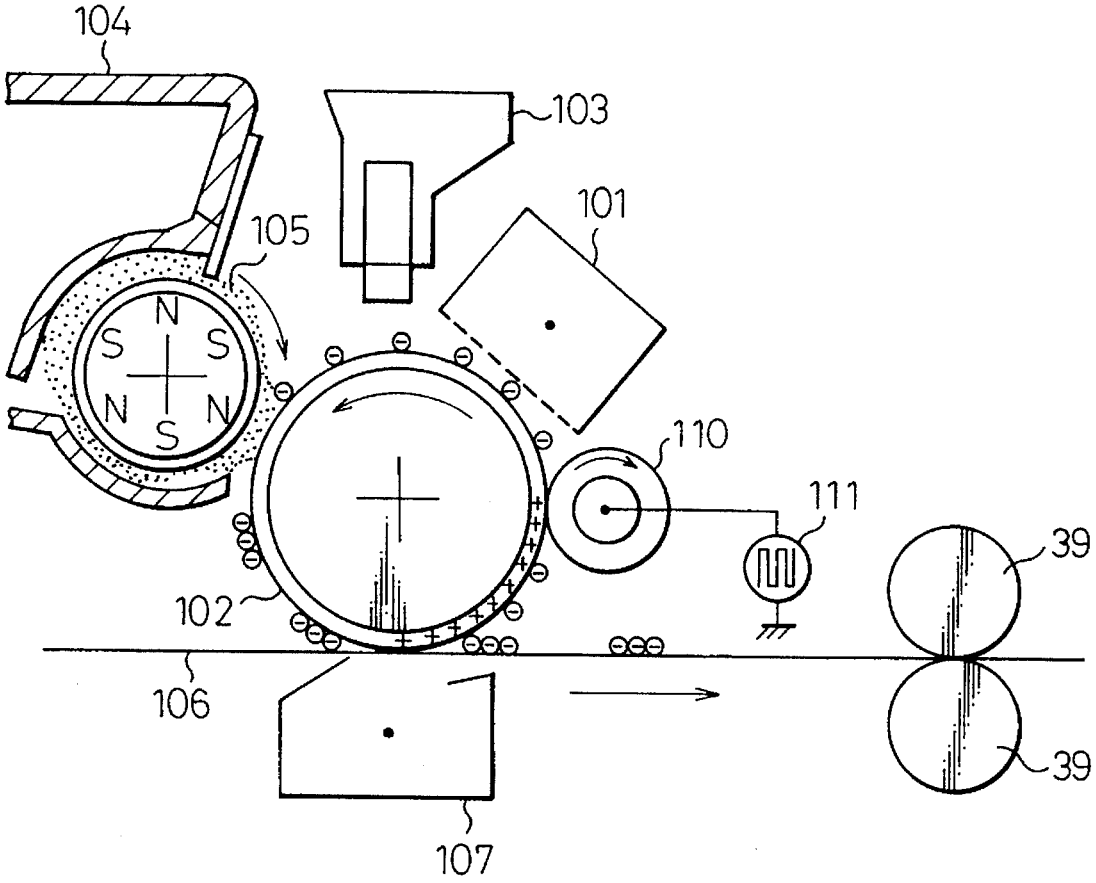
Fig.4 PRIOR ART
FIG. 4 is a cross-sectional view illustrating the prior art imaging device operable at the process steps shown in FIG. 3.
Figure 5:
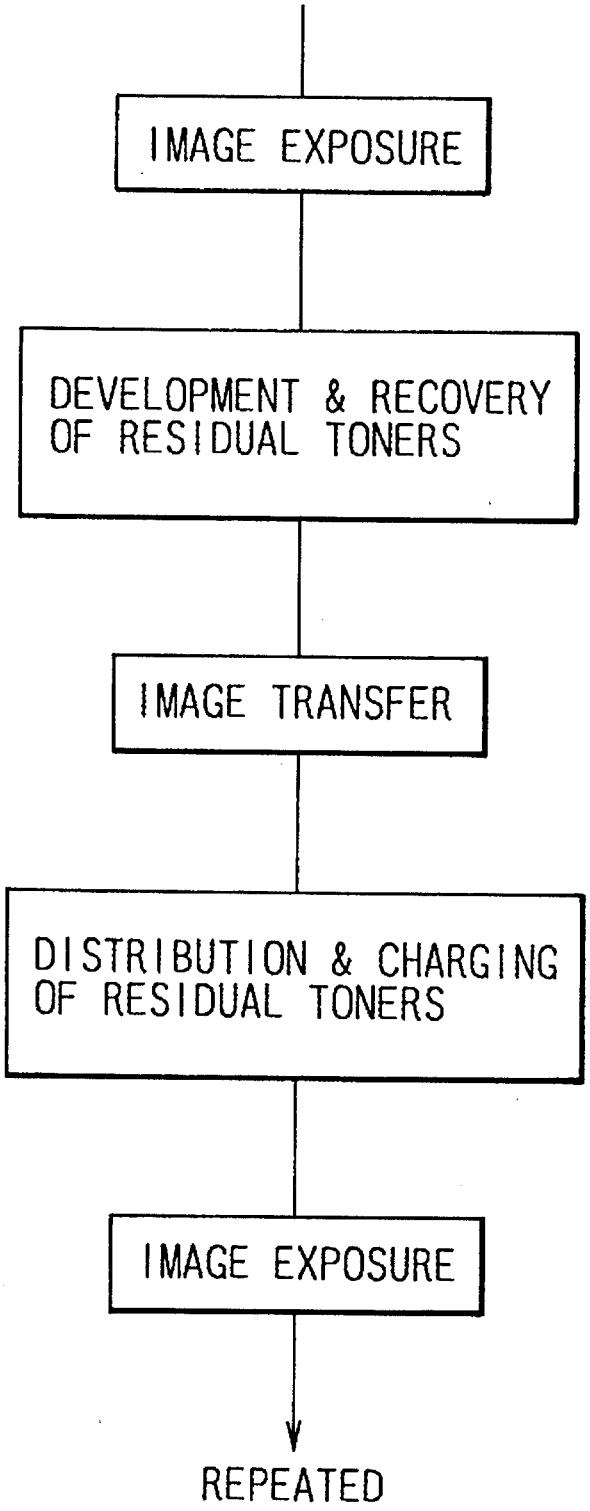
FIG. 5 is a diagramatic view showing a series of the process steps in the imaging device according to the present invention.

Generally, the electrographic imaging device according to the present invention can be advantageously operated at a series of the process steps shown in FIG. 5. Namely, the process steps include:

(a) image exposure;

(b) development of a latent image and recovery of the residual toners;

(c) image transfer; and (d) distribution and charging of the residual toners;

and these steps can be repeated. In the image exposure step, an image-carrying element such as a photosensitive drum is exposed to a light image in an optical image-providing system such as a LED array to form a charged latent image. The photosensitive drum has already been sensitized by electrical charging in the preceding toner distribution step which will be described hereinafter. The latent image is formed as a function of the photoconductive discharge of the electrically charged surface of the photosensitive drum.

The formed latent image is physically developed, with a toner as a developer, in a developing step. A visible image of the toner is formed on the drum surface a result of as an electrical attraction of fine particles of the toner thereon. At the same time, in this developing step, the residual toner uniformly distributed over the drum surface in the preceding toner distribution step is recovered and reused for developing.

The developed image of the toner is then transferred to an image-receiving element such as paper or other materials, and the transferred toner image is fixed thereon by fusing.

Following the image transfer step, the distribution and charging of the residual toner, i.e., the toner remaining on the drum surface, are carried out. In this step, the residual toner is uniformly distributed over the drum surface, and at substantially the same time, an electric charge is removed from the charged drum surface, while the drum surface is recharged, i.e., freshly charged, by an application of a DC voltage.

The above cycle for imaging is repeated for producing images is repeated. Note that, according to the present invention, a dust removing step for removing paper and other dust from the drum surface may be additionally located between the image transfer step and the toner distribution and charging step.

Figure 6:
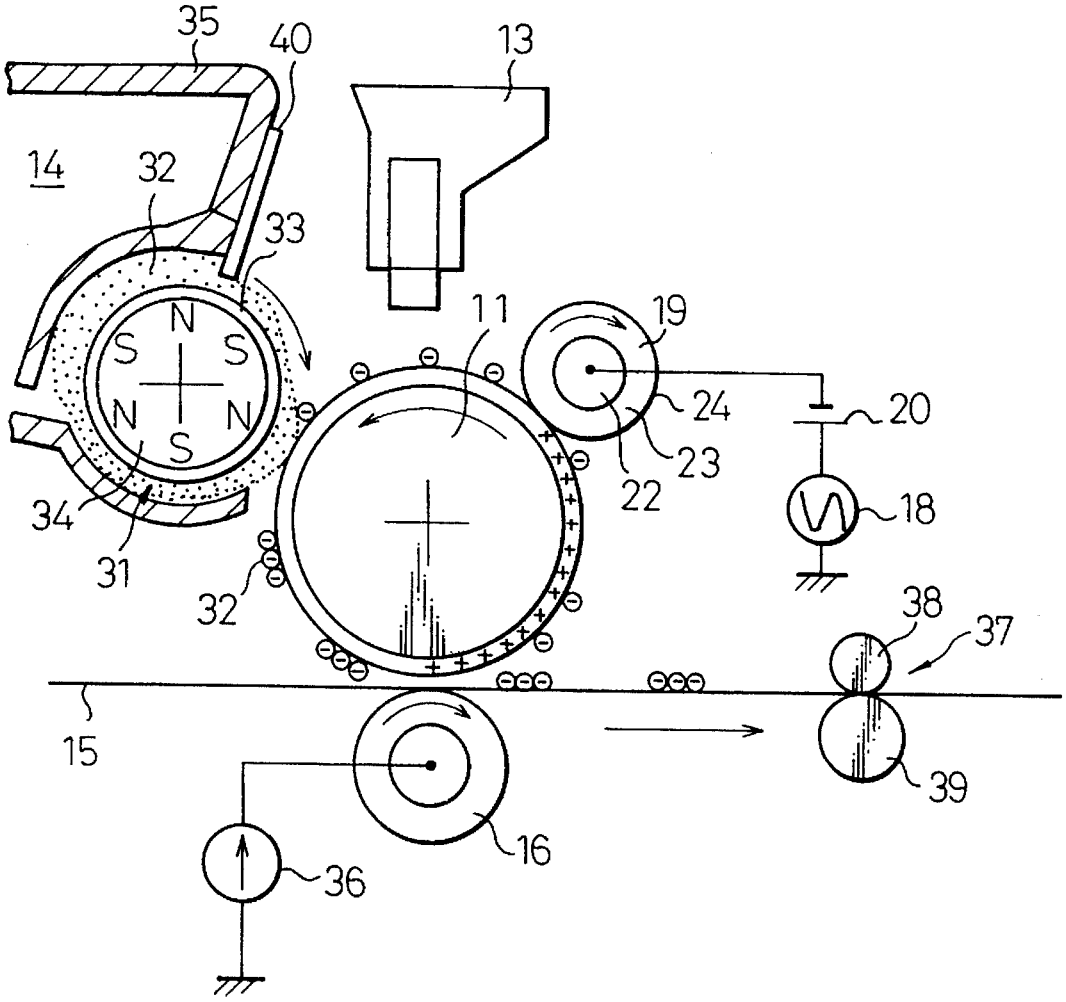
FIG. 6 is a cross-sectional view illustrating the imaging device operable at the process steps shown in FIG. 5.

FIG. 6 illustrates a typical example of an electrographic imaging device, according to the present invention, which is suitable for carrying out the above-described imaging process. A photosensitive drum 11 which is rotatable as shown by an arrow is exposed to light from a LED array 13 which can emit the light depending upon a predetermined imaging signal, thereby forming a charged latent image on the drum surface.

The latent image is physically developed by fine particles of a developer or toner 31 in a developing device 14. A visible image 32 of the toner is thus formed on the drum surface. Note that the developing device 14 can act as a recovery means for recovering the residual toner from the surface of the photosensitive drum 11, in addition to acting as a developing means of the charged latent image.

Since the drum 11 rotates, the developed toner image 32 is guided to an image transfer station which preferably comprises a transfer roller 16 electrically connected to a DC electric source 36. A paper 15 such as plain paper from a paper cassette, not shown, is introduced between, and into contact with, the drum 11 and the roller 16 in order to transfer the developed image from the drum 11 to a surface of the paper 15. The transferred image is fused and fixed to the paper surface, while the paper 15 passes between a pair of fixing rollers 38 and 39.

A distribution roller means 19 is located downstream of the image transfer station. The roller means 19 is preferably a conductive roller, and is rotated in contact with the photosensitive drum 11 bearing or residual not-transferred toner on the surface thereof. During the rotation thereof, the distribution roller means 11 can uniformly distribute the residual toner over the surface of the drum to thereby reduce the amount of the residual toner per area of the drum surface. Such uniform distribution of the residual toner can be further accelerated by applying an AC voltage to the roller means 19 from a DC electric source 20 because the roller means 19 is mechanically vibrated as a function of the application of the AC voltage, thereby causing forward and backward movement of the toner over the drum surface. Namely, although it is very difficult to move the toner over the drum surface by using; only a mechical means such as a conventional brush means, it was found by the inventors that if the roller means is mechanically vibrated, said vibration is transferred to the drum surface, thus causing separation of the toner from the drum surface, followed by reattachment of the toner to the drum surface. The reattached toner which is referred to herein as "residual toner" will be uniformly and evenly distributed over the drum surface. It is therefore possible to prevent a concentration of residual toner and to facilitate the collection of the residual toner in the developing device 14. It is also possible to deelectrify the residual charge on the drum 11 by the AC voltage applied from an AC electric source 18.

In addition, the distribution roller means 19 used in the imaging device of the present invention can act as a charging or precharging means, and accordingly, a conventional precharging means, generally located prior to the image exposure device, can be omitted from the imaging device. Electrostatic charging of the photosensitive drum 11 can be preferably attained by applying a DC voltage corresponding to a predetermined surface potential necessary to electrostatically charge the drum surface to the roller means 19 through a DC electric source 20 connected thereto.

Figure 7:
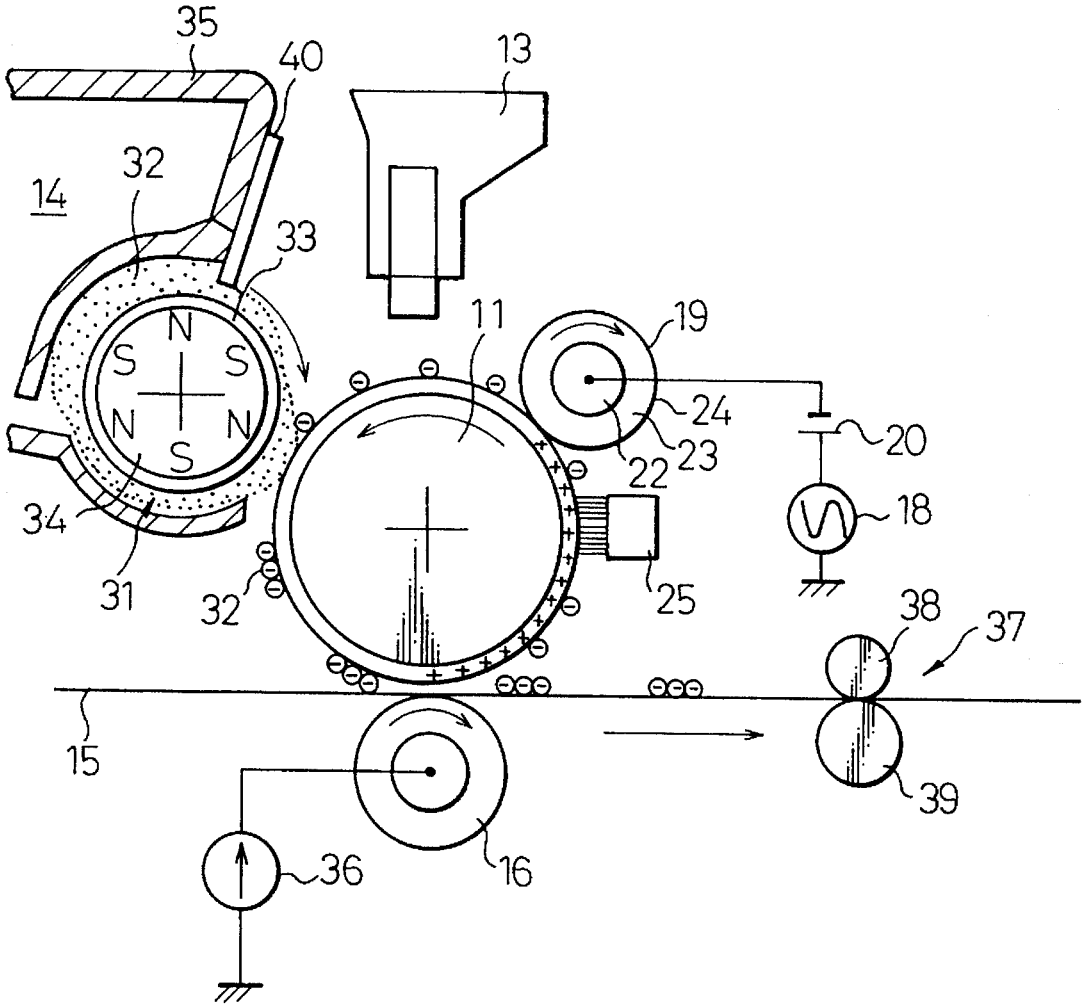
FIG. 7 is a cross-sectional view illustrating one modification of the image device of FIG. 6.

FIG. 7 is a modification of the electrographic imaging device illustrated in FIG. 6, and it should be noted that a dust removing brush 25, as a dust removing means, is located downstream of the image transfer station in order to remove paper and other dust from the surface of the drum 11.

In the practice of the present invention, an image-carrying element may be any conventional one in the field of electrographic imaging. Typical example thereof include a photosensitive drum, plate or belt. The photosensitive drum may comprise a metallic drum such as aluminum drum having applied over the surface thereof a photosensitive layer of selenium, selenium alloy, zinc oxide, cadmium sulfide, or organic photoconductor (OPC) materials such as phthalocyanine. A function separtion-type organic photoconductor material is advantageously used in the formation of the photosensitive layer. Both the diameter of the drum and the layer thickness of the photosensitive layer can be widely varied depending upon the dimensions of the imaging device and other factors. The photosensitive plate or belt may comprise a sheet-like support such as paper or plastic material with the applied photosensitive coating. The photosensitive coating may be formed from any conventional photosensitive material as in the formation of the photosensitive drum. Of course, any other constitutions may be applied to the formation of the image-carrying element, if they are appropriate.

An image exposure means is located over the image-carrying element such as photosensitive drum. The position of the image exposure means is selected so that an electrostatically charged latent image is suitably formed on a surface of the image-carrying element. Examples of suitable image exposure means include any conventional optical image-providing systems such as LED (light emitting diode), laser, liquid crystal shutter and EL (electroluminescence) optical systems. Hereinafter, a LED optical system is referred to as the image exposure means.

In the downstream side of the image exposure means, a developing means is disposed. The developing means used herein, as mentioned above, can act as a means for forming a visible image and a means for recovering the residual toner uniformly distributed over a surface of the image-carrying means. The developing means is preferably constituted that it includes a development sleeve and magnet roller which may be rotated in the same or opposite direction. If desired, the magnet roller may be fixedly mounted in the developing means. The developing means used herein is described in detail in the above-cited U.S. Pat. Application Ser. No. 08/220,208 filed Mar. 30, 1994, which is herein incorporated by reference.

Any developer may be used in the developing means, and can be a one component developer, a 1.5 component developer or a two component developer. Namely, the developer may comprise a magnetic or nonmagnetic toner with or without a magnetic or nonmagnetic carrier, and is hereinafter referred to briefly as "toner". The toner used is conventional one containing, as black pigments, carbon black and the like, and the carrier used is also conventional one such as magnetic powders, for example, iron or ferrite powder. The magnetic powders may be coated with or dispersed in a polymeric resin.

Preferably, a 1.5 component developer comprising both a magnetic toner and a magnetic carrier is used in a developing means which includes a concentrically rotatable development sleeve and magnetic roller. Use of the 1.5 component developer is particularly effective to increase an efficiency of recovering the residual toner in the developing means. Further, preferably, the magnetic toner may comprise a polymeric toner having a high transfer efficiency, because such a polymeric toner can be transferred to an image-receiving element such as paper with high efficiency, after being deposited as a latent toner image over the image-carrying means, thereby reducing an amount of the untransferred residual toner.

The reduced amount of the residual toner also means that the residual toner can be easily recovered in the developing means. Furthermore, preferably, the magnetic carrier used in combination with the magnetic toner comprises iron-based particles having an average particle diameter of 50 μm or less, more preferably 40 μm or less. This magnetic carrier is particularly effective to increase the efficiency of recovering the residual toner in the developing means.

An image transfer means for transferring the developed image to an image-receiving element is disposed downstream of the developing means. Any conventional transfer means or devices may be used in the imaging device of the present invention, however, an image transfer roller is preferably used, because it can retain a stable and high transfer efficiency under different environmental and transfer conditions, and also it can effectively prevent flapping of the image-receiving element frequently caused during transfer of the developed image from a photosensitive drum having a small drum diameter, i.e., large curvature surface. Further, the improved transfer efficiency of the toner means that the amount of the residual toner to be recovered in the developing means can be reduced. These advantages will greatly contribute to the improved cleanerless imaging process which is intended in the present invention.

The image transfer roller is preferably constituted so that it has the same or similar structure as that of the distribution roller which will be described in detail hereinafter. Preferably, the transfer roller comprises an electrically conducting body of the elastic material with closed cells having, on the peripheral surface thereof, an insulating coating.

In the image transfer roller, a predetermined level of constant electric current is preferably applied thereto. The operation of the transfer roller at the constant electric current is effective to constantly supply an electric charge to the image-receiving element, thereby to prevent, or at least to inhibit, a reduction in the transfer efficiency caused by environmental conditions. Further, a predetermined level of constant voltage is preferably applied to the transfer roller.

The operation of the transfer roller at the constant voltage is effective to attain a good transfer efficiency and a stable transfer of the toner images.

In order to receive the developed toner images from the image-carrying element, an image-receiving element is passed in contact with the image surface of the image-carrying element between the same element and the image transfer means. Any conventional materials such as paper, for example, plain paper, coated paper or synthetic paper, plastic sheets or films and others may be used as the image-receiving element. Before use, the material may be stored in a cassette or box or alternatively it may be stored in the form of roll and cut to the predetermined size before or after image transfer.

After the image transfer has been completed, the image-receiving element with the transferred image is guided to an image fixation station. Heating, solvent vapor fusing or other conventional technologies may be used in the image fixation station depending upon the specific toners and other factors. Preferably, a pair of fixing rollers may be used, and the images can be fixed to the image-receiving element upon heating or fusing.

In the imaging device of the present invention, the presence of a distribution roller means is most important because the distribution roller means can play multiple functions as briefly described hereinabove and will be described in detailed below. Namely, according to the present invention, since the distribution roller means is constituted as an electrically conducting roller, an AC voltage is applied to the roller for deelectrification (discharging) and distribution of the residual toner, and a DC voltage is applied for electric charging of the image-carrying element, it becomes possible not to use an electrification or charging device in the imaging device, and, as a result of the applied AC and DC voltages, it also becomes to attain a toner distribution effect, deelectrification effect and an electric charging effect at the same time. With regard to the application of the AC and DC voltages, the frequency and peak voltage of the applied AC voltage can be suitably selected depending upon the conditions of toner distribution, and the level of the applied DC voltage can be selected to adjust the predetermined surface potential of the image-carrying element.

The distribution roller means preferably comprises a metallic core or shaft having, over at least an outer surface thereof, a layer of an elastic and electrically conducting material having closed cells. The closed cells of the conducting layer can give a good elasticity to the roller means, while preventing a migration or incorporation of the toner into a body of the roller means and accordingly maintaining a stable resistibility value. Further, since the closed cells can provide fine impressions or depressions on the surface of the roller means, small gaps or spaces are produced at the contacting portion between the image-carrying element and the roller means during the image transfer. Such small gaps or spaces are effective to attain a stable electrification, because additional discharging is caused therein, thereby extend the area of the electrification of the image transfer.

The metallic core of the roller means is preferably made of any metallic material such as aluminum, an alloy thereof or other light-weight metals. If desired, any plastic or other materials may be used as a core or shaft material, in place of the metallic materials. The conducting layer is preferably made of foamed polyurethane having closed cells, although other naturally occurring or synthetic materials having closed cells may be used, if desired.

In a preferred embodiment of the present invention, the distribution roller means may further comprise a surface coating covering the conducting layer, and having an electric resistance higher than that of the conducting layer. The insulating surface coating is effective to maintain a good toner distribution function and a good electrification stability. More particularly, the surface coating can prevent an undesirable migration of the toner into the conducting layer of the roller means, thereby improving the durability of the roller means. Further, when an electric field is applied to the roller means for vibrating the roller means, the surface coating can assist in increasing the vibration, in width, of the mechanically vibrated roller means, thereby further increasing the toner distribution effect. The mechanical vibration of the roller means is also effective to return the toner adhering to the roller means to the image-carrying element.

The surface coating is preferably made from a resinous material selected from the group consisting of a polyamide such as nylon, for example, 6,6-nylon and others, a cyanoethylated polysaccharide such as cyanoethylated plulanes and derivatives thereof, and a cyanoethylated polyvinyl alcohol such as cyanoethylated celluloses and derivatives thereof. The reason why these resinous materials are suitable as the surface coating have not yet been clarified, however, it is thought to be because the resinous materials, comparing with conventional insulating resins, can exhibit a moderate hygroscopicity suitable in prevent an accumulation of electric charge, in addition to a high dielectric constant. The thickness of the surface coating may be varied, however, in order to avoid a complete filling of the depressions of the conducting layer with the surface coating, it is preferred that the surface coating has the thickness in the range of about 5 to 20 μm. The surface coating can be formed in accordance with any conventional coating methods such as spray coating and dip coating. Note that, in this coating, care must be taken in order to avoid clogging of the small pores on the surface of the conducting layer with the surface coating material.

As described above, the main function of the conducting layer of the distribution roller means is to provide a uniform distribution of the residual toner, thereby enabling an easy recovery of the residual toner in the developing means, and to provide an electrically uniform image-carrying element, i.e., deelectrification and then uniform electrification of the image-carrying element. Preferably, these functions can be further improved, amplified, if the conducting layer comprises a layer of the foamed polyurethane having incorporated therein electrically conductive fillers, and has a volume resistivity in the range of $10^3$ to $10^8$ Ω·cm Note, however, that a volume resistivity above $10^8$ Ω·cm must be avoided, because it does not result in a desired electrically uniform image-carrying element. Also, the volume resistivity below $10^3$ Ω·cm must be avoided, because, in such a case, a large amount of the conductive fillers are incorporated into the conducting layer, and therefore a strength and producibility of the roller means are reduced.

The conductive fillers to be included in the conducting layer can be suitably selected from a wide variety of powdery or particulate conductive materials, typical examples of which include carbon, graphite, metal such as iron or the oxides thereof, and conductive polymers such as polypyrrol, polyaniline and the like. These conductive materials may be used alone or in combination.

The polyurethane layer preferably used herein is a foamed one because it can exhibit a high efficiency in the toner distribution, deelectrification and electrification, compared with an unfoamed polyurethane layer having a flat surface. As previously mentioned, a strong electric field is produced due to a concentration of the electric field in the topographic surface of the foamed polyurethane layer.

In the foamed polyurethane layer as the conducting layer, it is preferred that the closed cells thereof have a cross section of a circle or ellipse wherein the ratio of the minor axis to major axis thereof is in the range of 0.7 to 1 and the minor axis has a length of 50 to 200 μm. It has been found that flatter the cells, the less the durabity of the conducting coating. This is because the circular or elliptic cells can exhibit a higher mechanical strength in comparison with the flat cells, and therefore can maintain a conductive path for an extended period of time. Note that since the conducting layer has a mechanical strength sufficient to prevent destruction of the cells during use, the resistivity of the roller means can be maintained. In other words, the roller means can stably display an excellent performance for an extended period of time.

The distribution roller means and particularly a conductive layer thereon preferably has a surface hardness, in terms of an Ascar C hardness, 50° or less, more preferably 30° or less. A roller means having the described surface hardness is particularly effective to ensure the formation of the desired nip between the image-carrying element and the roller means during image transfer.

The distribution roller means is preferably rotated at a peripheral velocity different from the photosensitive drum as the image-carrying element thereby further improving its effects of mechanically distributing the residual toner over the drum surface. The peripheral velocity of said distribution roller means and said drum is the value determined at a contacting site between said roller means and drum. It has been found that a preferable ratio of the peripheral velocity of the roller means to the photosensitive drum is in the range of −1 to +2 (not 1), and more preferably +1.1 to +1.5. Note that "plus (+)" means that both the drum and the roller means rotate in the same direction of the rotation.

Further, the distribution roller means is preferably operated so that an AC electric field with a frequency of 500 to 2000 Hz and an applied voltage of ±450 to ±800 volts, and a DC voltage corresponding to a predetermined surface potential of the image-carrying element, as an alternating electric field, are applied to the distribution roller means. As a result of application of the alternating electric field in the above-described manner, the roller means can suitably act as a toner distribution means and deelectrification means for the image-carrying element (by means of the AC electric field) and also as an electric charging means for the image-carrying element (by means of the DC voltage). No discrete electric charging device is required, and accordingly a simplified and compact structure of the device can be accomplished in the imaging device of the present invention.

In a preferred embodiment of the present invention, a predetermined constant DC current is applied to the distribution roller means. A suitable and proper electrification on the image-carrying element can thus be obtained.

In another preferred embodiment of the present invention, a predetermined constant DC voltage is applied to the distribution roller means. A suitable and proper electrification on the image-carrying element can thus be obtained.

Preferably, the imaging device of the present invention may further comprise a dust removing means for removing dust, originating from the image-receiving element, from the surface of the image-carrying means located between the image transfer means and the distribution roller means. A dust removing means such as a dust removing brush can effectively prevent a reduction in the toner distribution power and deelectrification power of the distribution roller means due to the attraction of paper and other dust into the roller means, and the introduction of such dust into the developing means.

The above-described imaging device according to the present invention will be further described with reference to FIGS. 7 to 9 in which one example of the preferred electrographic printer of the present invention is illustrated. Note, however, that any other electrographic imaging devices such as an electrographic copier or a copying machine, a facsimile printer or other devices can be similarly provided according to the present invention.

Figure 8:
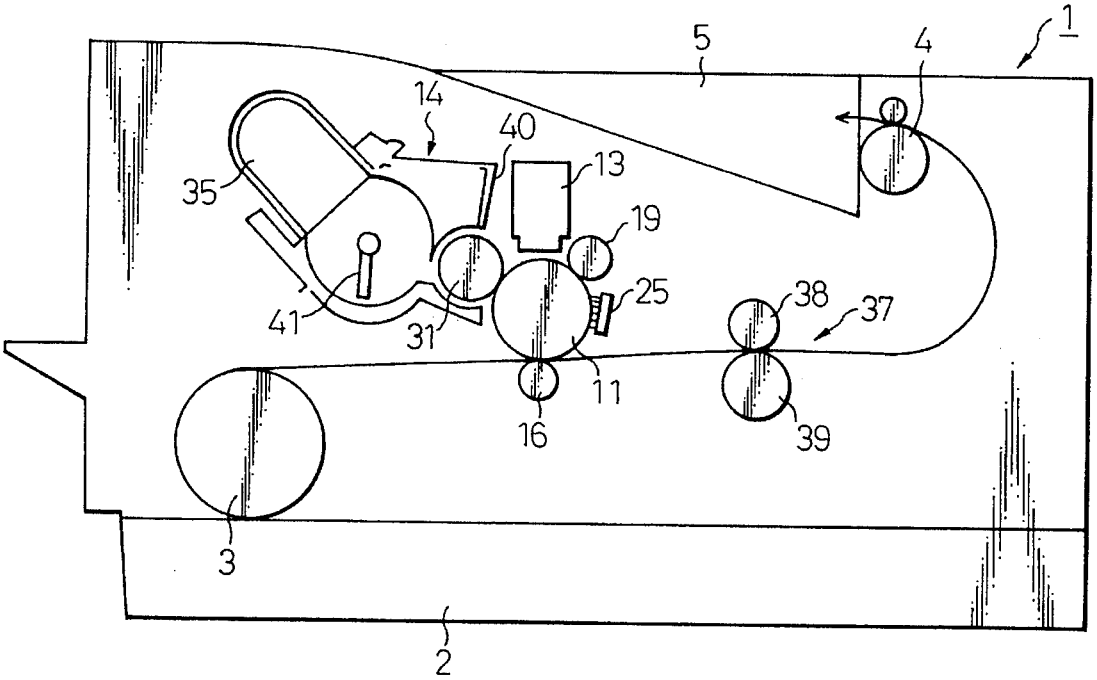
FIG. 8 is a schematic diagram illustrating a printing machine including the imaging device according to the present invention.
Figure 9:
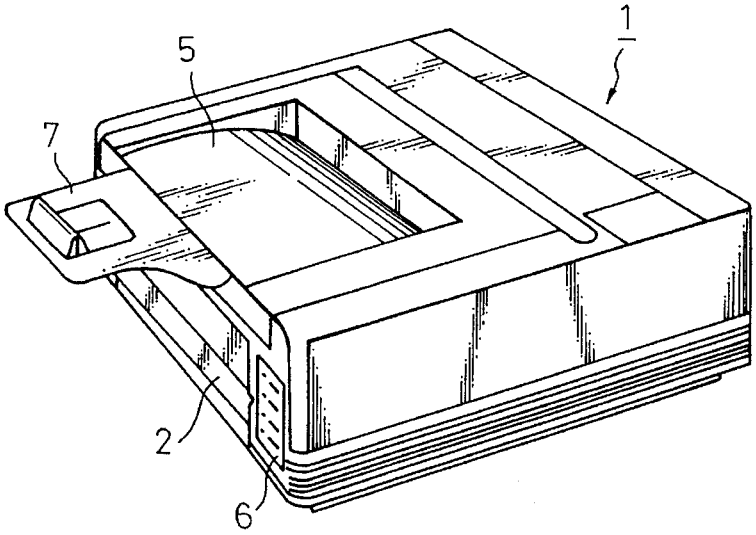
FIG. 9 is a perspective view of the printing machine of FIG. 8.

FIG. 7 is a cross-sectional view of the main part of the printer, a schematic diagram of which printer is illustrated in FIG. 8 and a perspective view of which printer is illustrated in FIG. 9. Referring now to FIG. 7, a photosensitive drum 11 as an image-carrying element comprises an aluminum drum having an outer diameter of 24 mm and a layer of the function separation-type organic photoconductor (phthalocyanine dye) having a thickness of about 20 μm, applied over a peripheral surface of the drum, and is rotatable in the direction of the arrow at a peripheral velocity of 25 mm/s. A surface of the photosensitive drum 11, as described hereinafter, has been uniformly charged to −580 volts by means of a toner distribution roller 19 which can also act as a charging means.

A LED optical system 13 is an optical unit, as an image exposure means or latent image-providing means, and can form a charged latent image over the surface of the photosensitive drum 11 as a result of imaging exposure of the same. The LED optical system 13 used herein is a combination of a LED array and a SELFOC (trade name) lens array. When the photosensitive drum 11 is subjected to an image exposure corresponding to a desired image pattern by using the LED optical system 13, an electrostatic latent image at −50 to −100 volts is produced on the drum 11.

Located downstream of the LED optical system 13 is a developing device 14, as a developing means, which can supply a developer (used herein is a mixture of a magnetic toner and a magnetic carrier) over the previously formed electrostatic latent image of the photosensitive drum 11 to thereby convert the latent image to a visible image, i.e., a developed toner image. Also, the developing device 14 can act as a means for recovering the residual toner from the photosensitive drum 11.

The developing device 14 includes a developer box 35 in which a developer 32 is contained. The developer 32 used herein is a mixture of an iron carrier in flat particles having an average particle size of 27 μm and a magnetic polymeric toner in the form of powders having an average particle size of 8 μm, a ratio, in weight, of the toner to the carrier being 25%, determined at a surface of a development sleeve described below. From the developer box 14, the developer 32 is supplied to the surface of a developing roller 31 which consists of a fixedly mounted magnet roller 34 and a development sleeve 33 surrounding the magnet roller 34. As can be seen, the photosensitive drum 11 and the development sleeve 33 are rotatable in the same direction. Note that, in the illustrated instance, no sensor for determining a toner concentration is shown, however, the concentration of the toner can be automatically controlled based on an initial amount of the carrier in the developer.

Located downstream of the developing device 14 is an image transfer roller 16 which is used to electrostatically transfer the developed toner image 32 from the surface of the drum 11 to a surface of paper 15. The structure of the transfer roller 16 is similar to that of the below-described toner distribution roller 19, and comprises a conducting body of an open-cell foamed material having applied thereon an insulating coating.

The transfer roller 16 is provided with a DC electric source or to a supply connected therewith. A DC voltage applied to the roller 16 can electrically charge the back surface of the paper 15, opposed to the toner image-carrying drum 11, thereby enabling a transfer of the developed toner image to the surface of the paper 15. Note that, in this instance, a DC electric source is used in order to supply a predetermined amount of electric charge to the paper, and to accordingly diminish a reduction of the transfer efficiency caused by variations in the environmental conditions.

After image transfer, the paper 15 with the transferred toner image is conveyed to a fixing device 37 which comprises a heating roller 38 which is provided with an installed halogen lamp as a heat source, and a pressure roller or backup roller 39. The toner image is fused and fixed onto the paper 15 upon heating the paper 15 by the heating roller 38.

An optional and replaceable dust removing brush 25 is disposed over the photosensitive drum 11 between the image transfer roller 16 and the toner distribution roller 19. The dust removing brush 25 can effectively remove paper dust and other dust from the surface of the used photosensitive drum 11, and accordingly can remove any undesirable influence on the imaging due to deposition of the dust on the drum surface and incorporation of the dust into the developing device. Preferably, the dust removing brush 25 is made of an insulating fiber brush. A suitable fiber is, for example, a polyacrylonitril fiber "Vesron" (trade name) commercially available from Toho Rayon Co. A provision of the dust removing brush 25 is preferred.

The toner distribution roller 19 is located between the image transfer roller 16 and the LED optical system 13, and can play three roles: uniform distribution of the toner, deelectrification of the photosensitive drum, and charging the drum. The distribution roller 19 is provided with an AC electric source 18 from which an AC voltage having a frequency of 800 Hz and a peak voltage of 1400 volts is applied to the roller 19, and also a DC electric source 20 from which a DC electric field having an offset voltage of −600 volts is applied to the roller 19. The structure and functions of the toner distribution roller 19 will be further described hereinafter.

Referring to FIGS. 8 and 9, a paper cassette 2 is removably disposed in a bottom portion of the printer 1. The paper cassette 2 contains cut sheets of paper as the image-receiving element. The paper is picked up by means of a pick-up roller 3 from the cassette 2.

The paper, after passing through the fixing device 37, is conveyed through a paper discharging roller 4 to a stacker 5 where the printed papers are temporarily stacked.

Using the above-described printer, printing can be carried out as follows:

A surface of the photosensitive drum 11 is uniformly electrified to a level of −580 volts by the toner distribution roller 19, and then subjected to an image exposure by using the LED optical system 13. An electrostatic latent image is thus formed over a surface of the drum 11. The background area has a voltage of −580 volts, and the image area has a voltage of −50 to −100 volts.

With rotation, the latent image is guided past the developing device 14. Since the development sleeve 33 of the developing roller 31 has an applied development bias voltage of −400 volts, the latent image is developed by a magnetic polymeric toner, which was negatively charged by stirring, with the magnetic carrier. A visible toner image is thus produced in the surface of the drum 11.

At the same time, the paper 15 is picked up, by the pick-up roller 3, from the paper cassette 2, and is then supplied to the image transfer roller 16, after the top end portion thereof is registered with a registering roller (not shown). The developed toner image is electrostatically transferred from the surface of the drum 13 to the surface of the paper 15 when the paper 15 passes between the drum 13 and the roller 16. After image transfer, the paper 15 with the transferred toner image is supplied to the fixing device 3 where the toner image is fixed to the paper 15 by fusing. The paper 15 with the fixed toner image is then conveyed through an U-shaped guide path to the paper discharging roller 4 where the paper 15 is discharged into the stacker 5.

After image transfer, the used surface of the photosensitive drum 11 comes in contact with the dust removing brush 25 in order to remove paper dust and the like from the drum surface. The not-transferred toner remains on the drum surface.

The photosensitive drum 11 then comes in contact with the toner distribution roller 19. During the contact of the drum 11 with the roller 19, the residual toner selectively adhered to the surface of the drum 11 is uniformly scattered and redistributed over the drum surface. At the same time, the residual charge is removed from the drum surface and the drum surface is uniformly charged to −580 volts by the toner distribution roller 19. The residual toner distributed over the drum surface, as previously mentioned, is re-used for further imaging or printing, after it is recovered in the developing device 14.

As can be seen from the above description, the illustrated printer 1 has a smaller dimension or size in comparison with that of the prior art printer, because it does not include either a cleaner or a separate charging device.

The illustrated printer 1 is shown as a perspective view in FIG. 9. The printer 1 is so designed that the paper cassette 2 is horizontally contained in the printer 1, and the printer 1 is operated from an operating panel 6 located in a front and surface of the printer 1. A paper guide 7 is provided on an end portion of the stacker 5 in order to avoid an overflow of the stacked papers and to arrange the papers.

The toner distribution roller used in the illustrated printer will be further described with reference to FIG. 10 which shows an enlarged cross-section of the distribution roller. Note, however, that the closed cells in the roller are illustrated at an enlarged scale in order to assist in understanding the performance thereof.

The toner distribution roller 19 capable of acting as a toner distribution means, deelectrification means and charging means is a rotatable roller consisting of the electrically conducting closed-cell foamed material, and more particularly comprises a metallic shaft or core 22 having coated on the peripheral surface thereof, in sequence, a conducting layer 23 of the elastic, closed-cell foamed material (polyurethane resin) and an insulating surface coating 24 of nylon resin.

For this instance the conducting layer 23 has a resistivity of $10^5$ Ω·cm and a surface hardness, determined in terms of Ascar C hardness, of 45 ° , and the surface coating has a thickness of 15 μm. The roller 19 is rotated at a ratio of the peripheral velocity to the photosensitive drum 11 of 1.2, while pressing the roller 19 against the drum 11 to an impression depth on the roller of about 0.3 mm.

Further, an alternating electric field having a frequency of 800 Hz, a peak voltage of 1400 volts and an offset voltage of −600 volts (accordingly, an AC voltage of ±800 volts) is applied to the roller 19 by means of the AC electric source 18 and DC electric source 20, see FIG. 7.

Figure 10:
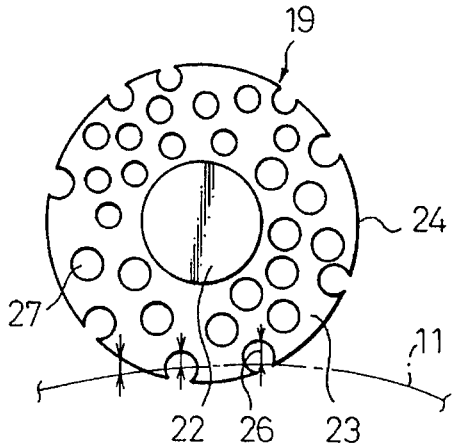
FIG. 10 is an enlarged cross-sectional view of the distribution roller means used in the imaging device of FIG. 5.

When both the drum 11 and the roller 19 are rotated in contact with each other while an AC voltage is applied to the roller 19, as illustrated in FIG. 10, fine gaps or spaces 26 can be produced in an interfacial area between the drum 11 and the roller 19 because of the presence of closed cells 27. The resulting gap or space 26 can act as a space for assisting the migration of the residual toner on the drum surface and also as a space for causing the necessary discharging therein.

As previously mentioned, the conducting layer 23 used in the imaging device of the present invention should be preferably based on a foamed polyurethane resin having incorporated therein conducting fillers, and should have a volume resistivity of $10^3$ to $10^8$ Ω·cm, more preferably about $10^5$ Ω·cm.

Further, closed cells 27 in the conducing layer 23 should have no open cell structure and accordingly they should not communicate with each other. Preferably, the cells 27 have a ratio of the minor axis to the major axis in the range of 0.7 to 1, and a minor axis thereof should have a length of 50 to 200 μm.

Figure 11:
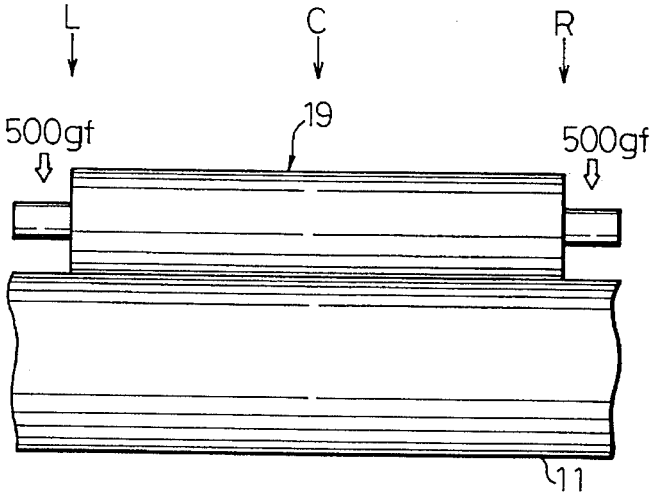
FIG. 11 is a schematic view illustrating the method used in the determination of an Ascar A hardness of the distribution roller means.
Figure 12:
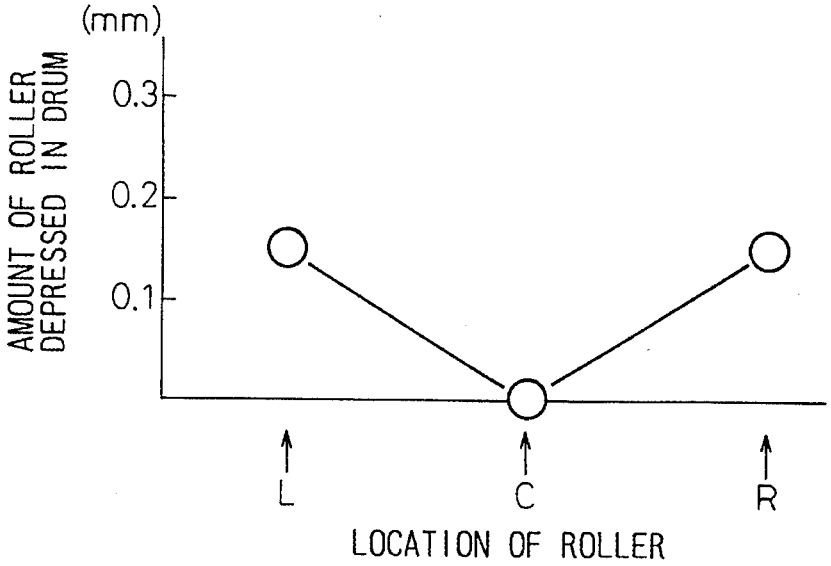
FIG. 12 is a graph showing a hardness characteristic of the distribution roller means ascertained by using the method of FIG. 11.

Furthermore, it is preferred that the conducting layer 23 has an Ascar C hardness of 50° or less, more preferably 30° or less. The reason why the above range of the Ascar C hardness is preferred will be appreciated from the test results of FIG. 12, see also FIG. 11: As illustrated in FIG. 11, the roller 19 of the foamed polyurethane resin was pressed against the drum 11 at 500 gf to obtain a depression of the roller 19 of 0.1, 0.2 and 0.3 mm. The roller 19 used herein had a length of 228 mm, outer diameter of 12 mm and diameter of the shaft of 6 mm as well as an Ascar C hardness of 50° . In the three points: L, C and R of the roller 19, a profile of the depression of the roller 19 was evaluated for each of 0.1, 0.2 and 0.3 mm in depression. No notable variation was observed in the profile of the depression. However, when the roller 19 having an Ascar hardness above 50° was pressed against the drum 11 at 500 gf, as is shown in FIG. 12, the resulting profile of depression was changed, and a central portion "C" of the roller 19 did not contact with the drum 11. It was also found that if the pressure is not applied to both ends of the roller 19, an unacceptably large distortion of the shaft can be caused.

Figure 13:
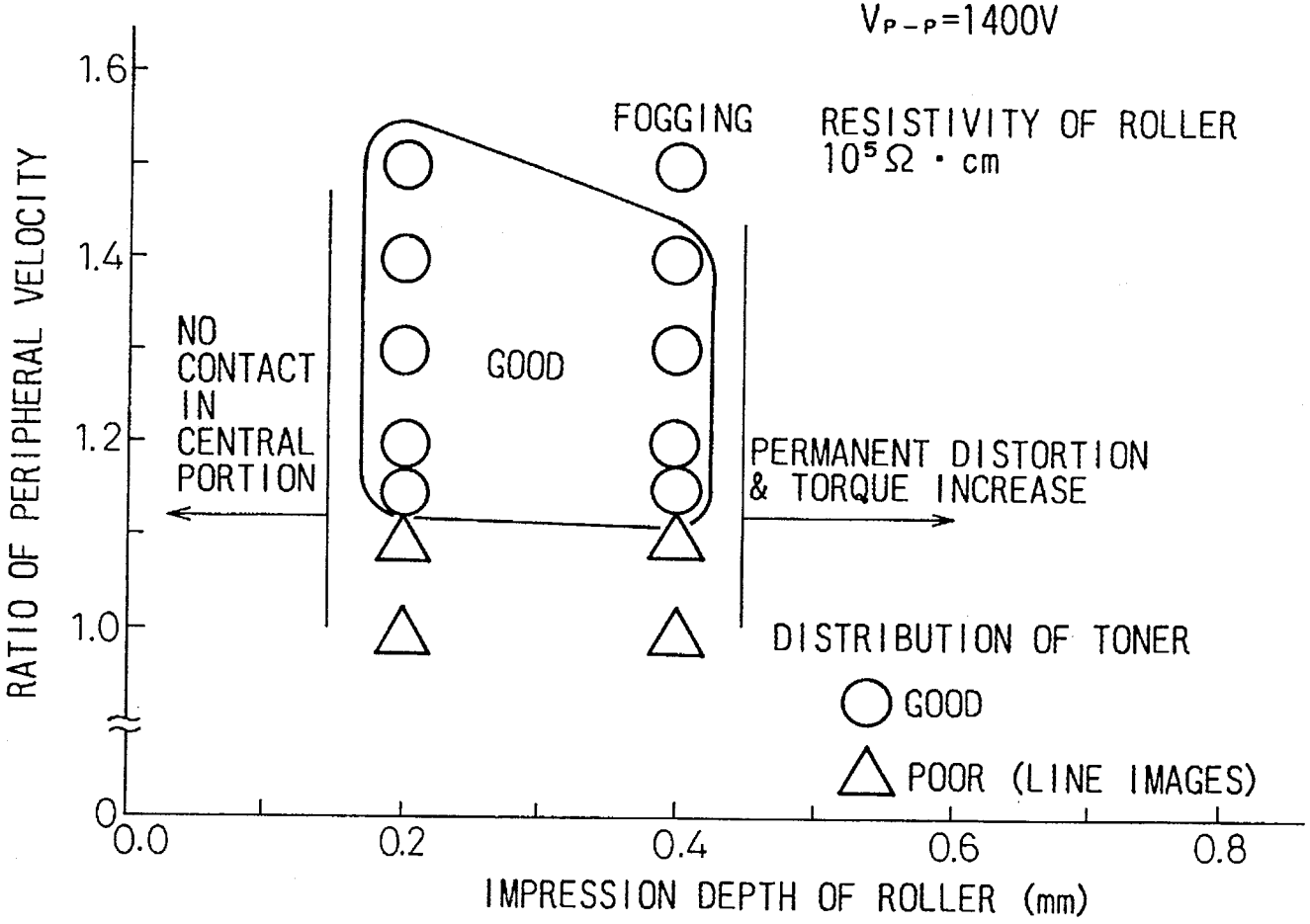
FIG. 13 is a graph showing a dependency of a toner distribution characteristic of the distribution roller means upon a ratio of peripheral velocity thereof and an impression depth thereof into the photosensitive drum.

FIG. 13 is a graph showing the dependency of the toner distribution characteristic of the distribution roller means upon the ratio of the peripheral velocities thereof and an impression depth thereof into the photosensitive drum. This graph indicates that good or satisfactory images can be obtained when the impression depth of the roller 19 into the drum 11 is in the range of about 0.2 to 0.4 mm and the ratio of peripheral velocity of the roller 19 to the drum 11 is in the range of about 1.1 to 1.5. The impression depth below about 0.2 mm should be avoided, because it does not result in a full contact of the roller 19 with the drum 11. Similarly, the impression depth above 0.4 mm should be avoided, because it causes a permanent distortion of the roller 19 and increases the torque required to rotate the roller 19.

In addition, the voltage applied to the roller 19 is preferably an AC electric field having a frequency of 500 to 2000 Hz and applied voltage of ±450 to ±800 volts, to which a DC voltage, corresponding to an electrification voltage to be applied to the drum 11 for charging, is added.

Figure 14:
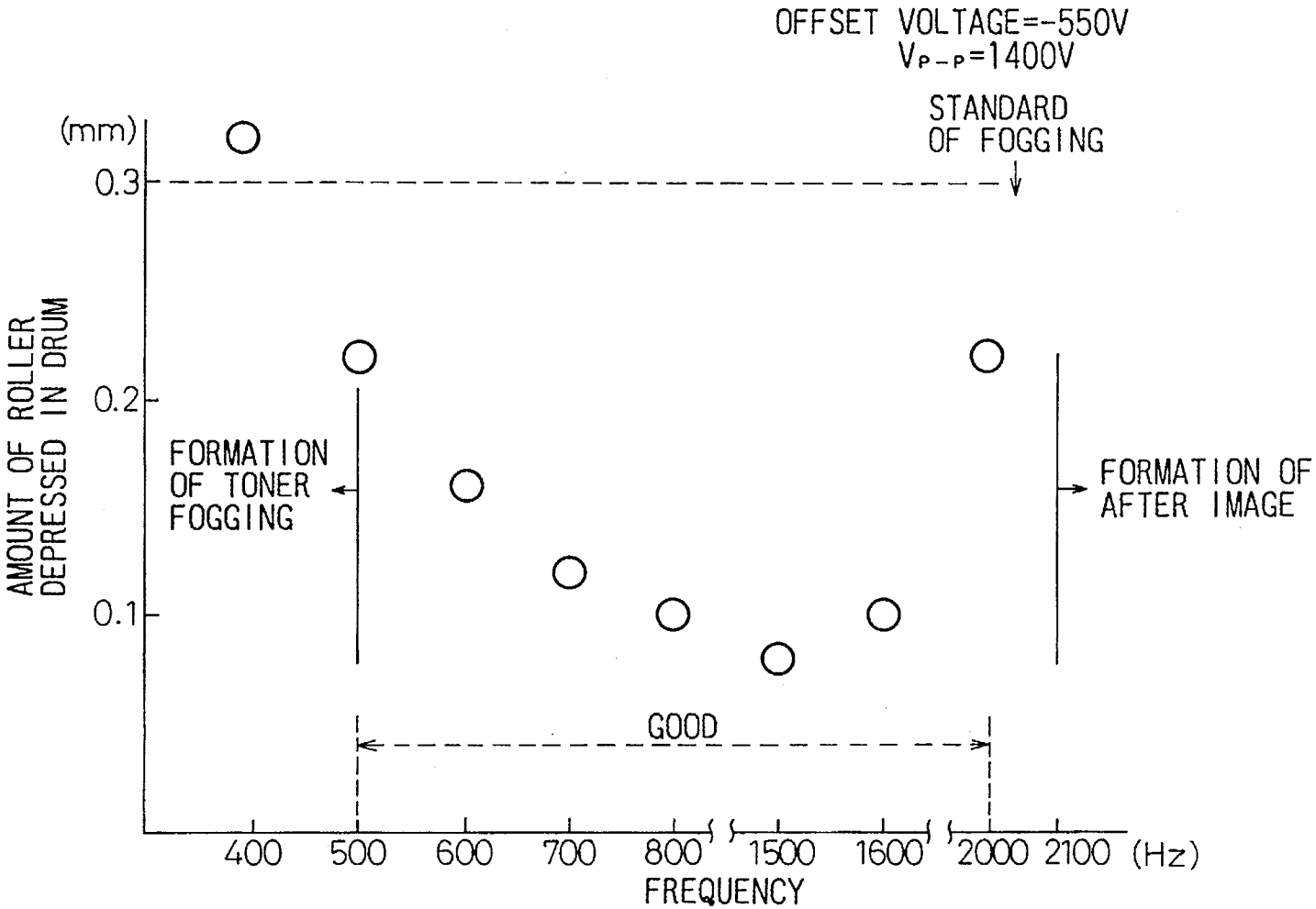
FIG. 14 is a graph showing a dependency of a toner distribution characteristic of the distribution roller means upon a frequency of the AC electric field applied to the roller means.
Figure 15:
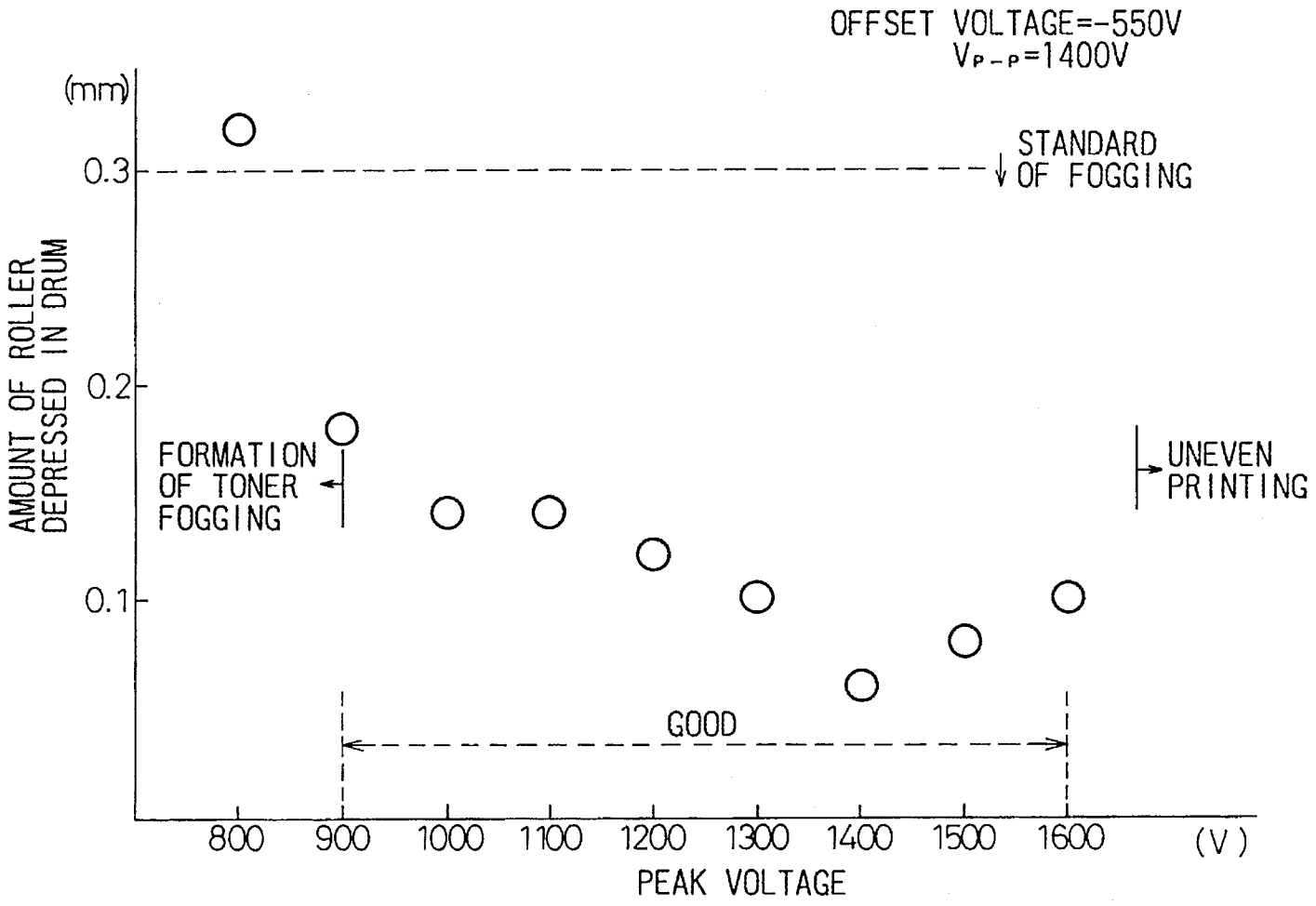
FIG. 15 is a graph showing a dependency of a toner distribution characteristic of the distribution roller means upon a voltage of the AC electric field applied to the roller means.
Figure 16:
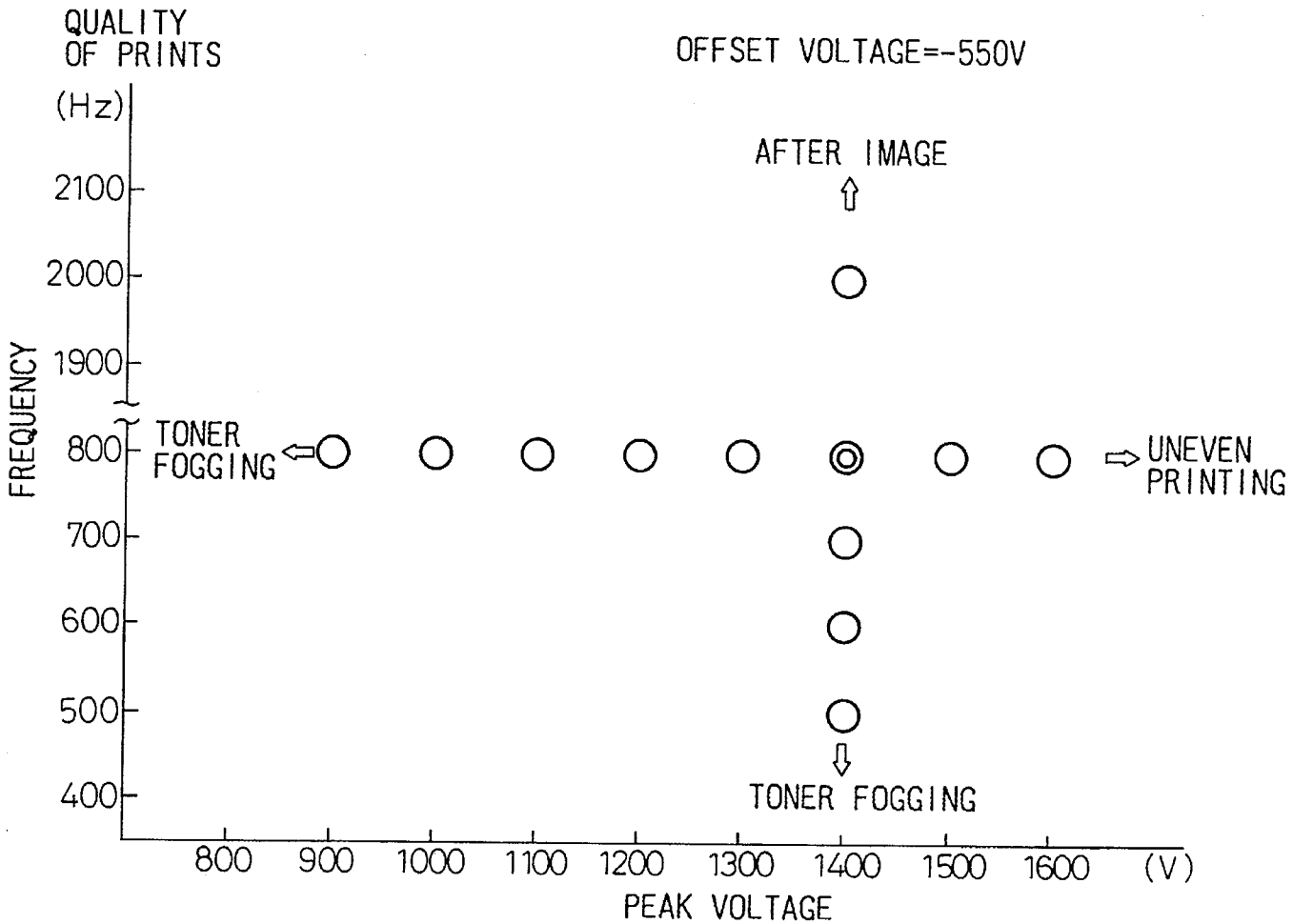
FIG. 16 is a graph showing a dependency of a toner distribution characteristic of the distribution roller means upon a frequency-voltage of the AC electric field applied to the roller means.

FIGS. 14, 15 and 16 each indicates the dependency of a toner distribution characteristic of the roller 19 upon:

- the frequency of the AC electric field applied to the roller 19;
- the voltage of the AC electric field applied to the roller 19; and
- the frequency and voltage of the AC electric field applied to the roller 19.

The graph of FIG. 14 indicates that if the applied AC voltage has a frequency of less than 500 Hz, fogging is produced in the resulting print due to toner fogging on the drum surface, and that if the AC voltage has a frequency of more than 2000 Hz, an after image is produced in the print. Further, the graph of FIG. 15 indicates that, at an applied offset voltage (DC voltage) of −550 volts, a peak voltage of less than 900 volts (corres. to an applied voltage of ±450 volts) results in fog in the print, and that a peak voltage of more than 1500 volts (corres. to an applied voltage of ±950 volts) results in uneven printing. These conclusions will be further clarified with reference to the graph of FIG. 16.

Further, the DC electric source may be an electric source of constant voltage. For example, when the roller 19 has a resistivity of $10^5$ Ω·cm, to avoid fog forming in the resulting prints, it is preferred to select a voltage in the range of 1.2 to 1.3 KV, as is shown in the following table.

| voltage (KV) | quality of print |
|---|---|
| 1.0 | Bad (notable fogging) |
| 1.2 | Good |
| 1.3 | Good |
| 1.4 | Bad (notable fogging) |

As mentioned in the above, the functions of the toner distribution roller mean are largely affected by the specific materials thereof. Accordingly, the following examples were made in order to ascertain how the materials of the roller means can affect the resulting prints.

EXAMPLE 1

A toner distribution roller was prepared by coating a cylindrical steel shaft, having a diameter of 6 mm, with, in sequence, a foamed polyurethane rubber as the conducting layer to a thickness of 2 mm and a 6,6-nylon resin, as the surface coating, to a thickness of about 10μm. The polyurethane layer as the conducting layer had a volume resistivity of $10^6$ Ω·cm and contained closed cells having a diameter of about 100 μm and a ratio of the minor axis to the major axis of about 0.8. The distribution roller was installed in a printer produced by Fujitsu Limited for testing which is substantially the same as that of FIG. 8 except for a conventional scotoron charging device located between the distribution roller and the LED optical system.

Using the above printer, a continuous printing test was carried out at a process velocity of 25 mm/s under the following conditions:

- photocondutor of the photosensitive drum . . . phthalocyanine organic photoconductor;
- applied voltage . . . sinusoidal wave having a voltage of +500 to −500 volts and a frequency of 250 Hz;
- ratio of the peripheral velocity of the distribution roller to the photosensitive drum . . . 1.2; and
- developer . . . two component developer consisting of a magnetic toner having a particle size of 9 μm and an iron powder-based carrier having a particle size of 30 μm.

The results of the printing test indicate that good and satisfactory printing qualities can be obtained in the resulting prints until 30,000 sheets of prints are produced.

EXAMPLE 2

The procedure of Example 1 was repeated except that the cyanoethylated plulane resin was used in place of the nylon resin in the formation of the surface coating. Comparable and satisfactory printing qualities could be obtained.

Example 3

The procedure of Example 1 was repeated except that a mixture of cyanoethylated cellulose and cyanoethylated polyvinyl alcohol (weight ratio of 2:1) was used in place of the nylon resin in the formation of the surface coating. Comparable and satisfactory printing qualities could be obtained.

EXAMPLE 4

The procedure of Example 1 was repeated except that the toner distribution roller was further used as a charging device. A DC voltage of −500 volts was applied to the distribution roller, in addition to the sinusoidal wave having a voltage of +500 to +500 volts and a frequency of 300 Hz. The results of the printing test evidence that good and satisfactory printing qualities can be obtained in the resulting prints, until 30,000 sheets of prints are produced.

EXAMPLE 5

The procedure of Example 1 was repeated except that the nylon surface coating was omitted from the distribution roller. Comparable and satisfactory printing qualities could be obtained for about 25,000 sheets of prints, however, stain the background portion was observed in the subsequent printing. Since the stain formation was due to too much toner adhered to the cells or spaces in the surface portion of the distribution roller, the previous satisfactory printing qualities could be obtained after such adhered toner was removed from the drum surface.

EXAMPLE 6

The procedure of Example 1 was repeated except that a ratio of the peripheral velocity of the distribution roller to the photosensitive drum was reduced to 0.8. Comparable and satisfactory printing qualities could be obtained.

EXAMPLE 7

The procedure of Example 1 was repeated except that a rectangular wave having a voltage of +700 to +500 volts and a frequency of 250 Hz was applied to the distribution roller. Comparable and satisfactory printing qualities could be obtained.

COMPARATIVE EXAMPLE 1

The procedure of Example 1 was repeated except that for comparison purposes, the ratio of the minor axis to the major axis in the closed cells of the foamed polyurethane layer was reduced to about 0.5. At the initial stage of printing, good and satisfactory printing qualities could be obtained in the resulting prints. However, after about 20,000 sheets of prints were produced, a stain appeared in the background portion of the prints. At this stage, it was found that an electric resistance of the toner distribution roller was increased to about $5\times10^{8}$ Ω·cm. The increase of the electric resistance is considered to be caused due to rupture of the cells which was observed upon microscopic inspection of the cross section of the cells in the foamed polyurethane layer.

COMPARATIVE EXAMPLE 2

The procedure of Example 1 was repeated except that for comparison purposes, an acrylic resin was used in place of the nylon resin in the formation of the surface coating. After about 1,000 sheets of prints were produced, a stain appeared in the background portion of the prints.

COMPARATIVE EXAMPLE 3

The procedure of Example 1 was repeated except that for comparison purposes, the volume resistivity of the polyurethane layer was increased to $10^{10}$ Ω·cm. After about 100 sheets of prints were produced, a stain appeared in the background portion of the prints.

COMPARATIVE EXAMPLE 4

The procedure of Example 1 was repeated except that, for comparison purposes, a silicone rubber layer with a flat surface having a volume resistivity of $10^{7}$ Ω·cm was used in place of the polyurethane layer as the conducting layer. After about 1,200 sheets of prints were produced, a stain appeared in the background portion of the prints.

COMPARATIVE EXAMPLE 5

The procedure of Example 1 was repeated except that for comparison purposes, the ratio of the peripheral velocity of the distribution roller to the photosensitive drum was adjusted to 1.0. After about 1,500 sheets of prints were produced, a stain appeared in the background portion of the prints.

COMPARATIVE EXAMPLE 6

The procedure of Example 1 was repeated except that for comparison purposes, a DC voltage of −600 volts was applied to the distribution roller. After about 500 sheets of prints were produced, a stain appeared in the background portion of the prints.

In addition to the explanation of the toner distribution roller, the developing device and the image transfer roller will be further explained.

As described above with reference to FIGS. 7 and 8, the developing roller 31 of the developing device 14 comprises a metallic development sleeve 33 and a stationary magnet roller 34 with a plurality of magnetic poles, mounted in an inner space of the sleeve 33. The developing roller 31 has a developer box 35 communicated therewith, and accordingly a magnetic developer is supplied from the box 35 to the roller 31, and then conveyed to the photosensitive drum 11 upon rotation of the sleeve 33. The magnetic developer may be a conventional one, and the developer used in the illustrated instance is a 1.5 component developer comprising a mixture of magnetic carrier and magnetic toner. The developer is also referred herein to, briefly, as a toner.

In the 1.5 component developer, a flat iron powder-based carrier having an average particle size of 27 microns was used as the magnetic carrier, and a polymeric toner having an average particle size of 8 microns, produced by a polymerization process, was used as the magnetic toner. The magnetic polymeric toner used herein can exhibit an excellent transfer efficiency in comparison with the conventional magnetic toner produced by a pulverization process, because its particle size is uniform and accordingly the distribution curve of the particle size thereof is sharp, and therefore, in the image transfer process, the developed toner image of the photosensitive drum can come in intimate contact with the paper for receiving the toner image, thereby enabling the formation of a uniform electric field at the image transfer station. For example, the transfer efficiency for the polymeric toner is not less than 90%, while that of the pulverized toner is in the range at the most of 60 to 90%. In this developer, the concentration of the magnetic polymeric toner is preferably in the range of 5 to 60% by weight, and the toner concentration applied to this instance is 25% by weight.

The developing device 14 is provided with a doctor blade 40 for controlling the amount of the developer supplied by means of the developing roller 31 in order to prevent a supply of an excess or insufficient amount of the developer or toner to the electrostatic latent image on the photosensitive drum 11. The control of the amount of the toner supplied can be made by changing the gap between an edge of the doctor blade 40 and a surface of the developing roller 31. Generally, the width of the gap is adjusted to be in the range of 0.1 to 1.0 mm.

The developing device 14 is further provided with an agitator 41 in an agitating chamber. The developer, after being supplied from the developer box 35 to the agitating chamber, is vigorously agitated by the actions of (1) the developer conveying power of the sleeve 33 of the developing roller 31, (2) the strength of the magnetic field of the developing roller 31, and (3) the barrier or toner supply-controlling function of the doctor blade 40. As a result of the frictional contact of the toner with the carrier, the toner is triboelectrically charged to a predetermined polarity and amount of charge. In this instance, the electrification series of the carrier and toner was controlled so that the toner was negatively charged.

In the illustrated instance, the image transfer roller 16 is constituted so that it has the same structure as that of the above-described toner distribution roller 19. Namely, as is easily appreciated from the above descriptions, the image transfer roller 16 may be an electrically conducting roller made of a closed-cell foamed material, and preferably comprises a metallic shaft or core having on its peripheral surface, in sequence, an elastic coating of a closed-cell foamed material as the conducting layer and an insulating surface coating.

In this instance, a DC voltage is supplied from the DC electric source 36 to the transfer roller 16. The DC electric source 36 is preferably a source of a constant current, and the preferred, range of the current can be varied depending upon the resistivity of the roller 16, as is appreciated from the following table.

| resistivity | electric current (A) | | | | |
|---|---|---|---|---|---|
| (ohm · cm) | 0.5 | 1.0 | 2.0 | 3.0 | 4.0 |
| $10^5$ | fair | good | good | good | bad |
| $10^6$ | fair | good | good | fair | bad |

The results of this table indicate that at a roller resistivity of 16 of $10^5$ ohm·cm, the preferred range of the DC electric current is 1 to 3 A, and at a roller resistivity of 16 of $10^6$ ohm·cm, the preferred range of the DC electric current is 1 to 2 A. A reduction in the transfer efficiency cannot be avoided if an electric current outside the above range is applied to the roller 16.

If desired, a constant DC voltage may be supplied from the DC electric source 36 to the transfer roller 16. As in the above-described constant electric current instance, the preferred range of the DC voltage can vary depending upon the resistivity of the roller 16. See the following table.

| resistivity | electric voltage (KV) | | | | |
|---|---|---|---|---|---|
| (ohm · cm) | 0.5 | 1.0 | 2.0 | 3.0 | 4.0 |
| $10^5$ | fair | good | good | bad | bad |
| $10^6$ | fair | good | fair | bad | bad |

bad: transfer efficiency is not more than 70% image transfer has scratches

This table indicates that when the resistivity of the roller 16 is $10^5$ ohm·cm, the preferred range of the DC voltage is 1 to 3 KV, and when the resistivity of the roller 16 is of $10^6$ ohm·cm, the preferred range of the DC voltage is 1 KV. A reduction in the transfer efficiency cannot be avoided if a DC voltage outside the above range is applied to the roller 16.

The present invention has been described with reference to preferred embodiments thereof. However, it should be noted that the present invention is not limited to the above-described embodiments, but may be modified in various forms invention. Therefore, the above-described examples and embodiments are to be considered as illustrative and not restrictive, and the present invention is not to be limited to the details given herein, but may be modified within the scope of the appended claims.

We claim:

1. An imaging device, for use in an electrographic imaging process, which comprises:

an image-carrying element;

image exposure means for forming a charged latent image on a surface of the image-carrying element;

developing means for forming a visible image on the surface of the image-carrying element as a function of developing said latent image with a developer and, at substantially the same time, recovering residual developer, not transferred to an image-receiving element in the preceding image transfer process, from the image-carrying dement carrying said residual developer;

image transfer means for transferring the visible image from the image-carrying element to an image-receiving element; and distribution roller means, made of an elastic and electrically conductive material, having depressions on its exterior surface for uniformly scattering and distributing the residual developer, which was not transferred to the image-receiving element in the above image transfer process, over the surface of the image-carrying element and, at substantially the same time, dedectrifying the charged surface of the image-carrying element with an AC electric field and, in combination therewith, freshly charging the deelectrified surface of the image-carrying element with a DC voltage.

2. An imaging device as defined in claim 1 in which said distribution roller means comprises a metallic core covered, on at least a surface thereof, with a layer of an elastic and electrically conductive material having closed cells.

3. An imaging device as defined in claim 2 in which said roller means further comprises a surface coating covering said layer of the elastic and electrically conductive material, the electric resistance of the surface coating being higher than that of said electrically conductive layer.

4. An imaging device as defined in claim 2 or 3 in which said electrically conductive layer comprises a layer of foamed polyurethane having incorporated therein electrically conductive fillers, and has a volume resistivity in the range of $10^3$ to $10^8 \Omega$·cm.

5. An imaging device as defined in claim 4 in which the closed cells of said foamed polyurethane have a cross section of a circle or an ellipse wherein the ratio of the minor axis to the major axis thereof is in the range of 0.7 to 1 and the minor axis has a length of 50 to 200 μm.

6. An imaging device as defined in claim 3 in which said surface coating comprises an insulating layer of a resinous material selected from the group consisting of polyamides, cyanoethylated polysaccharides and cyanoethylated polyvinyl alcohols.

7. An imaging device as defined in one of claims 1–3 in which said image-carrying element is a rotatable drum and is rotated at a peripheral velocity different from that of said distribution roller means.

8. An imaging device as defined in one of claims 1–3 in which said distribution roller means is designed so that both an AC electric field with a frequency of 500 to 2000 Hz and an applied voltage of ±450 to ±800 volts, and a DC voltage corresponding to a predetermined surface potential of the image-carrying element, as an alternating electric field, are applied to the distribution roller means.

9. An imaging device as defined in one of claims 1–3 in which said developing means is designed so that it operates in a 1.5 component development process and comprises a development sleeve and magnet roller, both being rotatable in a concentric mode, as well as a magnetic toner and a magnetic carrier.

10. An imaging device as defined in claim 9 in which said magnetic toner comprises a polymeric toner having a high transfer efficiency.

11. An imaging device as defined in claim 9 in which said magnetic carrier comprises iron-based particles having an average particle diameter of 50 μm or less.

12. An imaging device as defined in one of claims 1–3 in which said distribution roller means has a surface hardness, in terms of an Ascar C hardness, of 50° or less.

13. An imaging device as defined in one of claims 1–3 in which said image transfer means is a transfer roller located opposite to the image-carrying element, and the image-receiving element is guided between the transfer roller and the image-carrying element.

14. An imaging device, as defined in claim 13, in which a predetermined level of constant current is applied to the transfer roller.

15. An imaging device as defined in claim 13 in which a predetermined level of constant voltage is applied to the transfer roller.

16. An imaging device as defined in claim 1 in which a predetermined level of constant DC current is applied to the distribution roller means.

17. An imaging device as defined in claim 1 in which a predetermined level of constant DC voltage is applied to the distribution roller means.

18. An imaging device as defined in one of 1, 2, 3, 16, or 17 which further comprises a dust removing means for removing dust, originated from the image-receiving element, from the surface of the image-carrying means and which is located between the image transfer means and the distribution roller means.

19. An imaging device, as defined in claim 18, in which said dust removing means comprises an insulating fiber-filled brush.

20. An imaging device as defined in claim 1 in which said image-carrying element is a rotatable photosensitive drum having located, on its peripheral surface, in the recited order:

an optical image-providing system, selected from the group consisting of LED (light emitting diode), laser, liquid crystal shutter and EL (electroluminescence) optical systems, as said image exposure means;

a developing device including a development sleeve and a magnet roller as said developing means;

a transfer roller as said image transfer means; and an electrically conductive roller of an elastic material, containing closed cells, as said distribution roller means.

21. An imaging device as defined in claim 20 which further comprises a dust removing brush between said transfer roller and said electrically conductive roller.

22. An imaging device as defined in claim 4 in which said surface coating comprises an insulating layer of a resinous material selected from the group consisting of polyamides, cyanoethylated polysaccharides and cyanoethylated polyvinyl alcohols.

23. An imaging device as defined in claim 4 in which said image-carrying element is a rotatable drum and is rotated at a peripheral velocity different from that of said distribution roller means.

24. An imaging device as defined in claim 6 in which said image-carrying element is a rotatable drum and is rotated at a peripheral velocity different from that of said distribution roller means.

25. An imaging device as defined in claim 4 in which said distribution roller means is designed so that both an AC electric field with a frequency of 500 to 2000 Hz and an applied voltage of ±450 to ±800 volts, and a DC voltage corresponding to a predetermined surface potential of the image-carrying element, as an alternating electric field, are applied to the distribution roller means.

26. An imaging device as defined in claim 6 in which said distribution roller means is designed so that both an AC electric field with a frequency of 500 to 2000 Hz and an applied voltage of ±450 to ±800 volts, and a DC voltage corresponding to a predetermined surface potential of the image-carrying element, as an alternating electric field, are applied to the distribution roller means.

27. An imaging device as defined in claim 7 in which said distribution roller means is designed so that both an AC electric field with a frequency of 500 to 2000 Hz and an applied voltage of ±450 to ±800 volts, and a DC voltage corresponding to a predetermined surface potential of the image-carrying element, as an alternating electric field, are applied to the distribution roller means.

28. An imaging device as defined in claim 4 in which said developing means is designed so that it operates in a 1.5 component development process and comprises a development sleeve and magnet roller, both being rotatable in a concentric mode, as well as a magnetic toner and a magnetic carrier.

29. An imaging device as defined in claim 6 in which said developing means is designed so that it operates in a 1.5 component development process and comprises a development sleeve and magnet roller, both being rotatable in a concentric mode, as well as a magnetic toner and a magnetic carrier.

30. An imaging device as defined in claim 7 in which said developing means is designed so that it operates in a 1.5 component development process and comprises a development sleeve and magnet roller, both being rotatable in a concentric mode, as well as a magnetic toner and a magnetic carrier.

31. An imaging device as defined in claim 8 in which said developing means is designed so that it operates in a 1.5 component development process and comprises a development sleeve and magnet roller, both being rotatable in a concentric mode, as well as a magnetic toner and a magnetic carrier.

32. An imaging device as defined in claim 4 in which said distribution roller means has a surface hardness, in terms of an Ascar C hardness, of 50° or less.

33. An imaging device as defined in claim 6 in which said distribution roller means has a surface hardness, in terms of an Ascar C hardness, of 50° or less.

34. An imaging device as defined in claim 7 in which said distribution roller means has a surface hardness, in terms of an Ascar C hardness, of 50° or less.

35. An imaging device as defined in claim 8 in which said distribution roller means has a surface hardness, in terms of an Ascar C hardness, of 50° or less.

36. An imaging device as defined in claim 9 in which said distribution roller means has a surface hardness, in terms of an Ascar C hardness, of 50° or less.

37. An imaging device as defined in claim 4 in which said image transfer means is a transfer roller located opposite to the image-carrying element, and the image-receiving element is guided between the transfer roller and the image-carrying element.

38. An imaging device as defined in claim 6 in which said image transfer means is a transfer roller located opposite to the image-carrying element, and the image-receiving element is guided between the transfer roller and the image-carrying element.

39. An imaging device as defined in claim 7 in which said image transfer means is a transfer roller located opposite to the image-carrying element, and the image-receiving element is guided between the transfer roller and the image-carrying element.

40. An imaging device as defined in claim 8 in which said image transfer means is a transfer roller located opposite to the image-carrying element, and the image-receiving element is guided between the transfer roller and the image-carrying element.

41. An imaging device as defined in claim 9 in which said image transfer means is a transfer roller located opposite to the image-carrying element, and the image-receiving element is guided between the transfer roller and the image-carrying element.

42. An imaging device as defined in claim 12 in which said image transfer means is a transfer roller located opposite to the image-carrying element, and the image-receiving element is guided between the transfer roller and the image-carrying element.

43. An imaging device as defined in claim 4 which further comprises a dust removing means for removing dust, originated from the image-receiving element, from the surface of the image-carrying means and which is located between the image transfer means and the distribution roller means.

44. An imaging device as defined in claim 6 which further comprises a dust removing means for removing dust, originated from the image-receiving element, from the surface of the image-carrying means and which is located between the image transfer means and the distribution roller means.

45. An imaging device as defined in claim 9 which further comprises a dust removing means for removing dust, originated from the image-receiving element, from the surface of the image-carrying means and which is located between the image transfer means and the distribution roller means.

46. An imaging device as defined in claim 12 which further comprises a dust removing means for removing dust, originated from the image-receiving element, from the surface of the image-carrying means and which is located between the image transfer means and the distribution roller means.

47. An imaging device as defined in claim 13 which further comprises a dust removing means for removing dust, originated from the image-receiving element, from the surface of the image-carrying means and which is located between the image transfer means and the distribution roller means.

48. An imaging device as defined in claim 5 in which said surface coating comprises an insulating layer of a resinous material selected from the group consisting of polyamides, cyanoethylated polysaccharides and cyanoethylated polyvinyl alcohols.

49. An imaging device as defined in claim 5 in which said image-carrying element is a rotatable drum and is rotated at a peripheral velocity different from that of said distribution roller means.

50. An imaging device as defined in claim 5 in which said distribution roller means is designed so that both an AC electric field with a frequency of 500 to 2000 Hz and an applied voltage of ±450 to ±800 volts, and a DC voltage corresponding to a predetermined surface potential of the image-carrying element, as an alternating electric field, are applied to the distribution roller means.

51. An imaging device as defined in claim 5, in which said developing means is designed so that it operates in a 1.5 component development process and comprises a development sleeve and magnet roller, both being rotatable in a concentric mode, as well as a magnetic toner and a magnetic carrier.

52. An imaging device as defined in claim 5 in which said distribution roller means has a surface hardness, in terms of an Ascar C hardness, of 50° or less.

53. An imaging device as defined in claim 10 in which said distribution roller means has a surface hardness, in terms of an Ascar C hardness, of 50° or less.

54. An imaging device as defined in claim 11 in which said distribution roller means has a surface hardness, in terms of an Ascar C hardness, of 50° or less.

55. An imaging device as defined in claim 5 in which said image transfer means is a transfer roller located opposite to the image-carrying element, and the image-receiving element is guided between the transfer roller and the image-carrying element.

56. An imaging device as defined in claim 10 in which said image transfer means is a transfer roller located opposite to the image-carrying element, and the image-receiving element is guided between the transfer roller and the image-carrying element.

57. An imaging device as defined in claim 11 in which said image transfer means is a transfer roller located opposite to the image-carrying element, and the image-receiving element is guided between the transfer roller and the image-carrying element.

58. An imaging device as defined in claim 5 which further comprises a dust removing means for removing dust, originated from the image-receiving element, from the surface of the image-carrying means and which is located between the image transfer means and the distribution roller means.

59. An imaging device as defined in claim 10 which further comprises a dust removing means for removing dust, originated from the image-receiving element, from the surface of the image-carrying means and which is located between the image transfer means and the distribution roller means.

60. An imaging device as defined in claim 11 which further comprises a dust removing means for removing dust, originated from the image-receiving element, from the surface of the image-carrying means and which is located between the image transfer means and the distribution roller means.

61. An imaging device as defined in claim 14 which further comprises a dust removing means for removing dust, originated from the image-receiving element, from the surface of the image-carrying means and which is located between the image transfer means and the distribution roller means.

62. An imaging device as defined in claim 15 which further comprises a dust removing means for removing dust, originated from the image-receiving element, from the surface of the image-carrying means and which is located between the image transfer means and the distribution roller means.

63. The device of claim 1, wherein said depressions on the exterior surface of said distribution roller means are closed cells.

64. The device of claim 1, wherein the elastic and electrically conductive material of the distribution roller means includes closed cells having dimensions substantially equal to the dimensions of said depressions on the exterior surface.

* * * * *